US007905125B2

(12) United States Patent
Herdman

(10) Patent No.: US 7,905,125 B2
(45) **Date of Patent: *Mar. 15, 2011**

(54) PROGRAMMABLE LOCK WITH INTEGRAL CHANGE TOOLING

(75) Inventor: Rodrick A. Herdman, West Chester, OH (US)

(73) Assignee: JaNaKa Limited Partnership, Mason, OH (US)

( * ) Notice: Subject to any disclaimer, the term of this patent is extended or adjusted under 35 U.S.C. 154(b) by 83 days.

This patent is subject to a terminal disclaimer.

(21) Appl. No.: 11/374,299

(22) Filed: Feb. 23, 2006

(65) Prior Publication Data

US 2007/0193317 A1 Aug. 23, 2007

Related U.S. Application Data

(60) Provisional application No. 60/656,355, filed on Feb. 25, 2005.

(51) Int. Cl.
*E05B 25/00* (2006.01)
*E05B 27/00* (2006.01)

(52) U.S. Cl. ..... 70/383; 70/382; 70/384; 70/493

(58) Field of Classification Search ..... 70/367–368, 70/382–386, 340, 341, 343, 358, 376–378, 70/392, 493–495, DIG. 21, DIG. 37, DIG. 44, 70/DIG. 71, DIG. 75

See application file for complete search history.

(56) References Cited

U.S. PATENT DOCUMENTS

| | | | | |
|---|---|---|---|---|
| 856,556 | A * | 6/1907 | Townsend et al. | 70/339 |
| 1,218,065 | A | 3/1917 | Diesel | |
| 1,455,577 | A * | 5/1923 | Epstein | 70/419 |
| 1,650,568 | A | 5/1927 | Hurd | |
| 1,967,042 | A | 7/1934 | Schachinger | |
| 2,007,143 | A * | 7/1935 | Keil | 70/367 |
| 2,023,847 | A | 12/1935 | Liss | |
| 2,113,007 | A | 5/1937 | Swanson | |
| 2,202,329 | A | 5/1940 | Braune | |
| 2,294,495 | A | 9/1942 | Woodruff | |
| 2,427,837 | A | 7/1944 | Connell | |
| 2,370,862 | A * | 3/1945 | Johnstone | 70/367 |
| 2,596,720 | A | 5/1952 | Pastor et al. | |

(Continued)

FOREIGN PATENT DOCUMENTS

CA 695186 9/1964

(Continued)

OTHER PUBLICATIONS

MasterLock brochure, Apr. 2003, "Key Control Security", MO-15M (2 pages).

(Continued)

*Primary Examiner* — Suzanne D Barrett

*Assistant Examiner* — Alyson M Merlino

(74) *Attorney, Agent, or Firm* — Hasse & Nesbitt LLC; Daniel F. Nesbitt

(57) ABSTRACT

A key-operated lock that can be programmed for use with one of a plurality of user keys without disassembling the lock or replacing the tumblers, that employs a programming key and an integral change tool to effect the lock programming. The lock can be configured to permit or to prevent use of the user key to program or reconfigure the lock. The lock is typically manually latched or bolted into a locked configuration. The integral change tooling simplifies the lock programming operation, and avoids the need for carrying a separate change tool.

12 Claims, 16 Drawing Sheets

U.S. PATENT DOCUMENTS

| | | | | | |
|---|---|---|---|---|---|
| 2,629,249 | A | | 2/1953 | Mendelsohn | |
| 2,687,640 | A | | 8/1954 | Mir et al. | |
| 2,818,723 | A | | 1/1958 | Levin | |
| 3,070,987 | A | | 1/1963 | Baker et al. | |
| 3,183,692 | A | * | 5/1965 | Check | 70/383 |
| 3,190,093 | A | * | 6/1965 | Schlage | 70/383 |
| 3,234,768 | A | | 2/1966 | Russell et al. | |
| 3,257,831 | A | | 6/1966 | Schlage | |
| 3,260,080 | A | | 7/1966 | Wellekens | |
| 3,286,494 | A | | 11/1966 | Sussina | |
| 3,320,781 | A | * | 5/1967 | Hill | 70/384 |
| 3,395,558 | A | * | 8/1968 | Russell et al. | 70/493 |
| 3,425,248 | A | | 2/1969 | Duval | |
| 3,431,757 | A | | 3/1969 | Hori | |
| 3,492,843 | A | | 2/1970 | Schieber et al. | |
| 3,512,382 | A | | 5/1970 | Check et al. | |
| 3,516,271 | A | | 6/1970 | Nelson et al. | |
| 3,589,153 | A | | 6/1971 | Hill | |
| 3,599,456 | A | | 8/1971 | Bessim | |
| 3,605,462 | A | | 9/1971 | Hermann | |
| 3,667,262 | A | * | 6/1972 | Hill | 70/384 |
| 3,710,603 | A | | 1/1973 | Miller | |
| 3,774,424 | A | | 11/1973 | Ehrat | |
| 3,910,083 | A | | 10/1975 | Burlingame | |
| 3,967,481 | A | | 7/1976 | Schlage | |
| 4,030,325 | A | | 6/1977 | Ehrat | |
| 4,068,508 | A | | 1/1978 | Genakis | |
| 4,116,026 | A | | 9/1978 | Flint | |
| 4,142,391 | A | | 3/1979 | Paig | |
| 4,151,731 | A | | 5/1979 | Tucker | |
| RE30,198 | E | | 1/1980 | Oliver et al. | |
| 4,231,242 | A | | 11/1980 | Hill et al. | |
| 4,233,828 | A | | 11/1980 | Dauenbaugh | |
| 4,282,731 | A | | 8/1981 | Taksony | |
| 4,376,382 | A | | 3/1983 | Raymond et al. | |
| 4,403,486 | A | * | 9/1983 | Miyake | 70/383 |
| 4,412,437 | A | | 11/1983 | Smith | |
| 4,429,555 | A | | 2/1984 | Salsbury | |
| 4,440,009 | A | | 4/1984 | Smith | |
| 4,631,941 | A | | 12/1986 | Sjunnesson | |
| 4,638,651 | A | | 1/1987 | Surko, Jr. | |
| 4,655,063 | A | | 4/1987 | Foshee et al. | |
| 4,712,401 | A | * | 12/1987 | Monahan | 70/382 |
| 4,712,402 | A | * | 12/1987 | Monahan | 70/383 |
| 4,732,023 | A | | 3/1988 | Shen | |
| 4,741,188 | A | | 5/1988 | Smith | |
| 4,747,281 | A | * | 5/1988 | Monahan | 70/383 |
| 4,776,187 | A | | 10/1988 | Evans et al. | |
| 4,836,002 | A | * | 6/1989 | Monahan | 70/382 |
| 4,942,749 | A | | 7/1990 | Rabinow | |
| 4,966,021 | A | | 10/1990 | Boag | |
| 5,000,019 | A | | 3/1991 | Foster | |
| 5,088,306 | A | | 2/1992 | Field | |
| 5,138,856 | A | | 8/1992 | Chyun | |
| 5,168,734 | A | | 12/1992 | Duval et al. | |
| 5,177,466 | A | | 1/1993 | Lai | |
| 5,343,724 | A | | 9/1994 | Sornes | |
| 5,450,662 | A | | 9/1995 | Watts | |
| 5,502,991 | A | | 4/1996 | Sornes | |
| 5,615,566 | A | | 4/1997 | Brandt | |
| 5,682,779 | A | | 11/1997 | Dolev | |
| 5,718,136 | A | | 2/1998 | Aldieri et al. | |
| 5,752,400 | A | * | 5/1998 | Kim | 70/368 |
| 5,799,519 | A | * | 9/1998 | Hsiao | 70/358 |
| 5,819,569 | A | | 10/1998 | Herdman | |
| 5,839,307 | A | | 11/1998 | Field et al. | |
| 5,894,750 | A | | 4/1999 | Liaw | |
| 5,921,121 | A | | 7/1999 | Tang | |
| 5,921,122 | A | | 7/1999 | Lin | |
| 5,964,111 | A | | 10/1999 | Lambert | |
| D422,882 | S | | 4/2000 | Andrews | |
| 6,076,386 | A | | 6/2000 | Etchells et al. | |
| 6,079,240 | A | | 6/2000 | Shvarts | |
| 6,301,942 | B1 | | 10/2001 | Shvarts | |
| 6,425,274 | B1 | | 7/2002 | Laitala et al. | |
| 6,532,782 | B2 | | 3/2003 | Chiu | |
| 6,604,393 | B2 | | 8/2003 | Larsen et al. | |
| 6,722,171 | B1 | | 4/2004 | Ruan | |
| 6,776,017 | B2 | * | 8/2004 | Herdman | 70/338 |
| 6,860,131 | B2 | | 3/2005 | Armstrong et al. | |
| 2001/0047672 | A1 | | 12/2001 | Fuller | |
| 2002/0104346 | A1 | | 8/2002 | Field et al. | |
| 2003/0041630 | A1 | | 3/2003 | Laitala et al. | |
| 2003/0084692 | A1 | | 5/2003 | Herdman | |
| 2003/0159483 | A1 | | 8/2003 | Kondratuk et al. | |
| 2003/0217576 | A1 | | 11/2003 | Koluch | |
| 2004/0060333 | A1 | | 4/2004 | Armstrong et al. | |
| 2004/0221630 | A1 | * | 11/2004 | Herdman | 70/493 |

FOREIGN PATENT DOCUMENTS

| | | |
|---|---|---|
| DE | 2517-689 | 11/1975 |
| DE | 2649-736 | 4/1978 |
| EP | 0918124 A1 | 5/1999 |
| JP | UM 56-97075 | 8/1981 |
| JP | UM 5-007871 | 2/1993 |
| JP | UM 7-15971 | 3/1995 |
| JP | UM 8-10636 | 3/1996 |
| JP | UM 2577146 | 5/1998 |
| JP | 2005-002641 | 1/2005 |
| JP | 2005-076286 | 3/2005 |

OTHER PUBLICATIONS

Schliebanlagen GmbH Pfaffenhaim catalog, 2002, "Locking Systems for Highest Demands", "Profile Cylinder System K14", "Profile Cylinder System V14", "System W14", "Profilcylinder-System Integral" (7 pages).

Rodrick A. Herdman, U.S. Appl. No. 10/708,658, filed Mar. 17, 2004.

Rodrick A. Herdman, U.S. Appl. No. 11/192,755, filed Jul. 29, 2005.

Rodrick A. Herdman, U.S. Appl. No. 11/178,627, filed Jul. 11, 2005.

* cited by examiner

PROGRAMMABLE LOCK WITH INTEGRAL CHANGE TOOLING

CROSS REFERENCE TO RELATED APPLICATIONS

This application claims the benefit of U.S. Provisional Application No. 60/656,355, filed Feb. 25, 2005.

BACKGROUND OF THE INVENTION

This invention relates generally to cylinder locks, and more particularly to a programmable cylinder lock that allows for adapting the lock to operate upon insertion of a key having a different configuration than a key to which the lock was originally configured for operation.

In many organizations, such as businesses, apartment buildings, hotels, schools, etc., it is generally desirable to customize the locks to the particular organization. There are two general methods by which keys and locks may be customized. The first involves reconfiguring the drivers and tumblers in the lock so that a key with a particular top edge contour may operate the locks of the organization. The second involves configuring the keyways in the locks to accept keys having a unique pattern of longitudinal contours formed in their sides. The purpose of the exclusivity generated by these methods is to prevent unauthorized entry into the organization. When keys and locks formed by the second method are involved, it is not sufficient for opening the lock that one have a key having a top edge contour appropriate to the lock; the key must also include an appropriate longitudinal contour of grooves and/or ridges.

In general, standard, conventional locks include a housing that has a cylindrical bore therein. An elongated generally cylindrical plug is rotatably mounted within the bore. A plurality of cylindrical apertures or holes extend through the housing and can be aligned with corresponding cylindrical holes in the plug. Paired sets of drivers and tumblers are positioned within these holes (i.e., the drivers within the holes in the housing, the tumblers within the holes in the plug) and are capable of moving within the plug and housing in such a manner as to allow for rotational movement of the plug in response to a main key inserted in the lock. The arrangement and construction of the lock also causes one or more of these sets of drivers or tumblers to be positioned in the interface between the plug and housing to prevent relative rotation between the plug and the housing when the wrong main key or no main key is inserted in the lock. However, the relative positioning of the sets of drivers and tumblers, plug, and housing is such that, when the proper key is inserted, the drivers are substantially wholly within the holes in the housing and the tumblers are substantially wholly within the holes in the plug, such that the plug can be rotated without interference to an unlocking position.

Many locks or sets of locks also include two types of keys: tenant or user keys and master keys. In general, each tenant key will only open one lock of a particular subset of locks, whereas a master key may open all the locks of the subset. Over the course of time, the security of an organization may become compromised by the loss of control of one or more of the tenant keys. For example, in apartment buildings, hotels, or motels, a guest or renter may leave and inadvertently or intentionally retain a key. When this occurs, subsequent occupants or tenants cannot be secure in their persons and property. Thus it would be desirable to easily and quickly reprogram the locks to accept a new key or set of keys.

Locks that can be easily changed are also desired by businesses where several employees are in possession of keys to fit the locks. In such situations, an employee may be discharged or quit, but retain possession of a key. Further, an employee may lose a key, thus placing the security of the locked area in doubt. Locks that can be easily changed are also desired in matters of personal security. One example of such a situation is a school where teachers and/or administrators may wish to quickly change the configuration of locks on classroom doors to secure students inside the classroom and safely set apart from the hallways in the event that an undesirable or dangerous individual breaches the security of the school.

Locks that can be easily changed are also desired by homeowners when a member of the family has misplaced or lost the operative user key, or when the family desires to allow limited access to the house through a temporary reconfiguration of a lock to the house.

When keys are lost or are possessed adversely, the general response is to change the locks fitting the lost key to require a key with a new top edge contour to correspond to different length tumblers. Generally, the shape of the longitudinal inner walls of the keyway that confront the longitudinal contour on the side of the key is not changed due to the generally exorbitant cost of such a change.

In many conventional locks, rotation of the user or master key with the lock is only permitted in one direction. Generally, such uni-directional locks are manually latched to the closed position, without manipulation of the user key, and are opened or the latch unlocked by insertion and rotation of the operable user key within the lock. Examples of such locks and latches combinations include padlocks, certain deadbolt locks, and knob locks having a push-button locking or latching button on the inside knob. These locks are all characterized as permitting only unidirectional rotation of the lock cylinder or plug within the housing of the lock with an inserted user key.

There are several generally known methods in the prior art for changing the configuration of drivers and tumblers in standard cylinder locks. Some of these methods involve removing the drivers and tumblers from a lock and replacing them with a different set of drivers and tumblers. However, there are many disadvantages to these prior methods of changing locks. First, these methods are tedious and time consuming. Second, they generally require the presence of a locksmith. And finally, they require disassembly and reassembly of the actual lock structure along with removal and replacement of the lock in a door.

An improved programmable lock is disclosed in US Patent Publication 2004-0221630 published Nov. 11, 2004, which discloses a changeable lock assembly suitable for re-keying a lock without disassembly of the lock. The assembly includes a housing and a plug rotatably mounted in the housing, with a keyway to receive at least a first user key and a second user key. The lock further includes a plurality of change members movable within the lock between a first position to a second position to reconfigure the lock for operation with on of the user keys. When a particular change member is in the first position, the first key operates the lock, and when the change member is in the second position, the first key does not operate the lock. The lock assembly can also employ a separate change tool that can be manipulated within the lock during the change procedure to reset the lock to operate with a different user key. While this programmable lock provides several benefits when a lock needs to be re-keyed, further improvements in a programmable key-operated locks are needed.

Thus, it would be desirable to provide and construct a lock that permits rapid programming of the lock to a different design or configuration to operate with a different user key. It would further be desirable to provide a lock that allows the operative key to be changed without removal of the plug from the lock, and/or other disassembly of the lock structure. It would be further desirable to provide a lock wherein the user key can not be used to program or change the configuration of the lock. It would also be desirable to provide a changeable, programmable key-operated lock that can be reconfigured with only a programming or operable user key, and uses an integral change tooling, to obviate the need to carry and manipulate a separate change tool.

SUMMARY OF THE INVENTION

The present invention relates to a changeable lock assembly that can be reconfigured to operate with different keys of a set of user keys, without disassembling the lock, employing a plurality of change members moveable within the lock between a first position and a second position, the change member being moveable from the first position to the second position by insertion and operation of an operable key, and moveable out of its second position by manipulation of an integral change tooling within the lock, wherein the positioning of the change members within the lock determine the configuration of the lock for operation with a user key.

The present invention relates to a changeable lock assembly that can be reconfigured to operate with different keys of a set of user keys, without disassembling the lock, comprising: a) a housing having a cylindrical bore with an inner surface and a plurality of driver chambers intersecting the bore surface; b) a plurality of drivers, each driver being movable within one driver chamber and being urged toward the bore surface; c) a plug having a cylindrical periphery and rotatably mounted within the bore so as to form a shear line at the interface of the bore surface and the plug periphery, the plug having a front end and a rear end and being rotatable between a first rotated position and a second rotated position, the plug further having: a longitudinal axis; 1) a keyway formed through the front end of the plug that is oriented parallel to the longitudinal axis and configured to receive a key selected from a subset of keys, the subset of keys including at least a first user key having a first contour edge, and a second user key having a second contour edge, wherein the first contour edge and the second contour edge each have at least a first contour position and a second contour position and are differently configured; 2) a plurality of tumbler chambers intersecting the plug periphery and the keyway, and being generally orthogonal to the longitudinal axis of the plug, each tumbler chamber being aligned with a driver chamber when the plug is at the first rotated position with respect to the housing so as to form a pin chamber; and 3) a plurality of retainer cavities formed into the periphery, each retainer cavity being spaced apart from a corresponding tumbler chamber and aligned with a corresponding driver chamber when the plug is at the second rotated position with respect to the housing; and 4) a change tooling configured integrally with the plug, and comprising at least one biasing member associated with a retainer cavity, the change tooling being moveable between a first position and a second position; d) a plurality of tumblers, each tumbler being movable within a tumbler chamber; e) a plurality of lock configuration change members, each change member being associated with one pin chamber, movable within the lock between a first position within the pin chamber between the driver and tumbler, and a second position within the retainer cavity, and being movable from the second position within the retainer cavity upon manipulation of the change tooling to its second position, wherein the user configuration of the lock is based upon the positioning of the change members in the plurality of pin chambers, and wherein the retainer cavity is configured to retain a change member when the change tooling is in its first position, and wherein the biasing member displaces the change member from the retainer cavity when the change tooling is manipulated into its second position.

The invention also relates to a lock kit, comprising: a) a changeable lock assembly described herein; b) instructions for use c) an optional subset of keys including at least a first user key having a first contour edge that operates the lock in a first lock configuration but does not operate the lock in a second lock configuration, and a second user key having a second contour edge that operates the lock in the second lock configuration but does not operate the lock in the first lock configuration, wherein the first contour edge and the second contour edge have at least a first contour position and a second contour position that are differently configured, and a programming key to change the configuration of the lock; and d) a means for securing the optional subset of keys, lock assembly, and the instructions.

The present invention also relates to a method for reprogramming a lock from operation by a first user key to operation by a second user key, the method comprising: a) providing a subset of keys including at least a first user key and a use second key, and a programming key, each of the keys having a top contour, the second user key having a different top contour than the first user key, the first key being operable to operate the lock; b) providing a changeable lock assembly that is configured to operate with a first user key, comprising a housing and a rotatable plug with a keyway, wherein the plug can be rotated between a first position to a program position; c) inserting the programming key into the keyway and rotating the plug to the program position; and d) manipulating a change tooling integral in the plug, to engage at least one retainer cavity in the plug configured to retain a lock configuration change ball, to displace the lock configuration change member from the retainer cavity, thereby enabling programming of the lock; e) rotating the plug to the first position; f) removing the programming key and disengaging the change tool, and inserting the second user key; g) rotating the plug back to the program position, to program the lock for operation with the second user key; and h) rotating the plug back to the first position.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
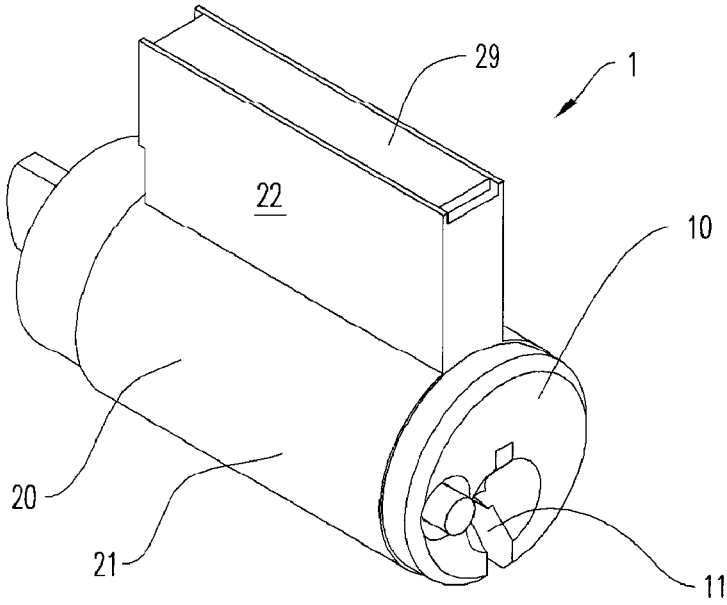
FIG. 1 shows a perspective view of a lock of the present invention.

The changeable lock typically includes a housing with a bore and a plug (or lock core) rotatably mounted within the housing. The housing has a cylinder portion having a cylindrical bore with a longitudinal axis, and a stack portion extending outwardly from the barrel portion. The stack portion of the housing has a plurality of holes or driver chambers extending radially from the centerline of the housing bore, which intersect the bore. The housing is typically inserted into a suitably configured opening in a door, a body of a padlock, or another object, where operation of the lock can open, and optionally close, a latch or other means for securing the door, padlock or object.

The plug has a longitudinal axis and a keyway that is configured to receive a key. Rotation of the plug within the bore of the housing establishes a primary shear line or arc at the intersection of the driver chamber and the bore. The plug has a plurality of radially extending holes or tumbler chambers that penetrate the periphery and intersect with the keyway.

The tumbler chambers and the driver chambers receive, respectively, the drivers and tumblers of the lock. When the plug is in a first position within the housing bore, the alignment of the radially-extending tumbler chambers with the radially-extending driver chambers form a plurality of pin chambers. Each pin chamber is provided with a tumbler that is positioned for axial movement within the tumbler chamber, and a driver that is positioned for axial movement within the driver chamber. Either the driver or tumbler can extend from the respective driver chamber or tumbler chamber to span across the shear line. A typical changeable lock of the present invention can have 4, 5, 6, 7, 8 or more pin chambers.

The lock also comprises a plurality of a change member. In its first position, the change member resides within the pin chamber between the tumbler and the driver. In its second position within the lock, the change member can reside within a separate retainer recess or cavity located in or otherwise associated with the plug. Typically, the lock comprises a plurality of the retainer cavities formed in the periphery of the plug, aligned in a first row parallel to the axis of the plug. The change member can have the same size or a size smaller than that of the diameter or width of the driver and tumbler. By moving one or more change members between one or more of the pin chambers and the retainer cavities, the lock configuration can be programmed to operate with one of a set of user keys.

The change cavity is typically sized to accommodate the change member, wherein the change member can lie entirely within the void of the change cavity. The change cavity is typically sized and shaped to conform to the size and shape of the change members. A typical change cavity shape is a cylindrical bore, into which a spherical, disk-shaped, or barrel-shaped change member can reside.

The change member can have a variety of shapes and configurations, including the spherical and cylindrically-shaped disk or barrel-shaped change member. The change member can also be a cylindrical member with a central hole, typically as a disk with a circular axial bore. The outer edge of the ring is typically configured with a vertical outer wall that confronts orthogonally the inner walls of the pin chamber, and can have a close-tolerance fit within the sidewalls of a correspondingly configured change cavity. In this embodiment, the change cavity can have a corresponding shape of an annular cavity with a centrally disposed post. The inside hole formed in the change ring typically has an inner diameter that is at least larger than the post that is formed into the surface of the periphery of the plug when the circular retainer cavity is formed, as discussed hereinafter. The central hole of the change ring typically can have a close-tolerance clearance for the post, to enable the change ring to be raised orthogonally to the axis of the post when moving the change ring out of the annular retainer cavity. Though shown as a circular aperture, the inner aperture can be other shapes that accommodate the post.

The height of a change disk or change ring can be any height for security, key management, or other purposes. Because the change disk or change ring can occupy a portion of the height of the pin chamber, minimizing the height can increase the number of key contour heights that can be provided to each user key, thereby increasing lock capacity, and improving lock security. Typical height is at least 0.010 inch, and more typically between about 0.030 inch to about 0.10 inch. Typically the heights of individual change members associated with the several pin chambers within a lock can be the same or different. The difference in between change members can be random, or more typically of fixed increments in height. Typical specific heights include 0.045 inch, 0.060 inch, 0.075 inch, and 0.090 inch.

It can also be understood that one or more of the pin chambers and retainer cavities can be configures to hold two, or more, change members, which can be moved one by one, by successive user keys having progressively shallower contour positions that can raise the change members above the shear line and into the retainer cavities.

Each user key of the set of user keys has a blade portion that is inserted into the keyway. The blade has a top contour that defines a plurality of contour positions, each position associated with a pin chamber. When inserted into the keyway, the contour positions raise the respective tumbler, driver, and change member (if present) within the pin chambers. Generally, if any of the driver or tumbler bodies span across the shear line, then the plug will not rotate within the housing.

In one embodiment, the lock is configured for rotation of the plug within the housing in a first direction, from its first position to a second position, typically a lock position for the latch or bolt, when operated with a user key. The lock can also be configured for rotation of the plug in an opposed second direction, from its first position to a third position, typically an unlocked position for the latch or bolt, when operated with a user key.

Insertion of the programming key into the keyway causes any change member positioned within the pin chamber to be raised into the respective driver chamber. As the plug is rotated in a direction toward a programming position, typically the plug's second position, the change members are captured within the driver chambers below the respective drivers. At the programming position, the aforementioned retainer cavities in the plug become aligned with the driver chambers of the housing, and a driver biasing member or spring over the driver forces any change member present out of the driver chamber and down into the corresponding retainer cavity in the plug.

In order to program the configuration of the lock for use with a new user key, one or more of the change members are moved from their retainer cavity, back into their respective first positions within the pin chamber. Typically, all of the change members are returned to the pin chamber for reconfiguring the lock. With the lock in the afore-mentioned programming position, the change members are moved or forced from their respective second positions in the retainer cavities with change tooling. The change tooling is provided integrally with the lock and is configured for manipulation in combination with the programming key. The change tooling comprises one or more biasing members, each biasing member being configured to move between a first position out of engagement with one of the retainer cavities, wherein a change member in the retainer cavity is not biased out of the cavity, and a second position in engagement with the retainer cavity, wherein the change member is biased out of the retainer cavity.

The integral change tooling simplifies the lock programming operation, and avoids the need for carrying a separate change tool.

The change tooling can comprise a plurality of individual components having a biasing member, or a single component having a plurality of the biasing members. The integral change tooling can typically comprise an elongated change tool comprising a plurality of biasing portions or surfaces, corresponding with the plurality of retainer cavities.

In one embodiment, the change tool can be configured for manipulation within the plug to move the biasing portions between the first position out of engagement with the retainer cavity, and the second position in engagement. The plug can have a change tool slot formed into the plug of the lock that intersects at least a portion of the plurality of retainer cavities. The change tool is disposed within the change tool slot whereby manipulation of the change tool within the slot causes the plurality of biasing surfaces to move into and out of engagement with the respective retainer cavity.

In an alternative embodiment, the change slot can be disposed a distance from the plurality of retainer cavities, and the change tooling can further comprise an intermediate mechanical linkage that can be brought into mechanical communication with the plurality of retainer. The intermediate mechanical linkage comprises the biasing member. The intermediate mechanical linkage can move between two positions: a first position wherein a portion thereof is disposed within the change slot and can be manipulated with the change tool; and a second position wherein the intermediate mechanical linkage has been moved by the manipulated change tool to intersect with the retainer cavity, thereby biasing any change member out of the retainer cavity. The interiorly-disposed change slot can be formed within the body of the plug, or extending radially outward from a sidewall of the keyway.

With the plug in the programming position, a change member positioned within the retainer cavity can be biased out of the cavity and into the driver chamber by movement of the biasing surface into its cavity-engagement position. Consequently, manipulation of the change tool causes the plurality of biasing surfaces to engage each change member disposed within the retainer cavity to be raised out of its retainer cavity and into its corresponding driver chamber. Typically, the engaging portion and the change member are configured to be raised out of its retainer cavity and into the corresponding driver chamber. Where a change ball is used, the engaging portion and the retainer cavity can be configured to raise the change ball at least halfway out of the retainer cavity, where a centerline of the change is outside the retainer cavity and beyond the periphery of the plug. If the change ball is at least halfway out of the retainer cavity when the change ball encounters a shear line, such as the lower rim of the driver chamber, then the change ball will be forced out of the retainer cavity and into the driver chamber.

The integral change tooling can be manipulated in a variety of ways to cause movement of the biasing surfaces into and out of engagement with the retainer cavities. The change tooling typically has a manipulated end that projects from the plug. More typically, since the change tool is typically disposed along the longitudinal axis of the plug, the change tooling projects from the front end or the back end of the plug. The change tooling can be pushed, pulled, or rotated, or pushed and rotated, within an opening, or revolved within a slot, formed into the front face or rear end of the plug.

In an embodiment of the integral change tooling, the change tool can comprise a plurality of a biasing surface, configured as a slanted surface oriented along the length of the change tool. When the change tool is either pushed (or conversely pulled) in an axial direction relative to the plug, from its first position toward the second position, the biasing surfaces of the tool move axially into engagement with the retainer cavities. In this embodiment, the change member rises up the slanted biasing surface as the tooling is moved within the slot.

The depressable (or conversely pullable) end of the elongated change tool can be configured proximate to either the front end or face of the lock, through which the keys are inserted, or alternatively from the rear end or face of the lock. Typically, the depressable (or conversely pullable) end or button extends through an opening formed in the front or rear face of the plug, and can be manipulated with a finger or hand, or other implement, to move the elongated change tool inwardly toward (or conversely outwardly from) the plug. The button end of the change tool, can be integral with the change tool, or can be a separate piece, and is typically cylindrical or oval shaped and extends through a similarly-shaped and sized opening formed in the front end or the rear end of the plug.

In another embodiment of the change slot, the change slot can be disposed a distance from the plurality of retainer cavities, and the change tooling can further comprise an intermediate mechanical linkage that can be brought into mechanical communication with the plurality of retainer cavities. Each intermediate mechanical linkage is disposed within a linkage cavity that communicates between the change slot and a corresponding change cavity. Typically the intermediate mechanical linkage is an elongated pin member that can move axially within the elongated linkage cavity. Typically the elongated linkage cavity is oriented perpendicular to the length of the change slot. In a typical embodiment, the change slot is formed radially inwardly from the line of retainer cavities, toward the centerline of the plug. A plurality of linkage cavities are formed as bored holes into the plug, beginning at the base of each retainer cavity and extending radially inwardly toward the change slot. An elongated cylindrical pin is disposed within each linkage cavity. The length allows the pin to lie substantially completely within the linkage cavity, with either the inboard end or the outboard end extending substantially completely into the change slot or the retainer cavity, respectively. The linkage pin moves between two positions: a first position wherein the inboard end of the pin is within the change slot and the outboard end is out of the retainer cavity; and a second position wherein the inboard end of the pin has been moved by the manipulated change tool out of the change slot, and the outboard end has been moved to intersect with the retainer cavity, thereby biasing any change member out of the retainer cavity. The interiorly-disposed change slot can be formed within the body of the plug, or extending radially outward from a sidewall of the keyway.

In an embodiment employing a change ring and an annular retainer cavity, the change tooling can intersect at least a portion of the circular retainer cavity, so that manipulation of the change tool within the change slot causes the change tooling to impinge upon the change ring and to cause the change ring to be lifted at least partially out of, and in a typical embodiment completely out of, the circular retainer cavity. The axial hole of the change ring typically fits in slidable contact with close tolerance over the cylindrical post, whereby an upward force placed upon even only a portion of the lower surface of the circular change ring raises the change ring upward into contact against the driver, causing the plane on the bottom surface of the circular ring to be raised substantially normal to the axis of the post, and substantially to or beyond the periphery of the plug. This ensures that when the plug is in the programming position, and the change ring is manipulated out of the circular retainer cavity with the change tool, the change ring can be displaced into and retained within the driver chamber when the plug is subsequently rotated away from the programming position. In alternative embodiments, the change slot is formed as a linear slot on one side or the other of the post, along the aligned plurality of retainer cavities, or as a pair of linear change slots can be formed on each side of the post.

Another embodiment of the integral change tooling can comprise a tool that is configured to rotate within the change tool slot. The change tool can comprise an elongated cylindrical member having a plurality of grooves formed along its length, in registry with the retainer cavities. The groove forms a void, within which a change member can be disposed, and will remain in the retainer cavity when the change tool is in the dis-engaged position. When the cylinder is rotated to the engaged position, the biasing surface of the groove proximate the tool periphery engages the retainer cavity and displaces the change member out of the retainer cavity and into the drive chamber. A rotatable end for the rotating change tool can be manipulated with a finger or hand, or other implement such as a screw driver engaging a slot in the end, to rotate the change tool within the plug.

After the plug is rotated back to the first position, the change tooling can be allowed or caused to disengage or move out of intersection with the retainer cavity. The change tooling typically includes a means for biasing or returning the change tool toward its first, disengaged position. For example, in the depressable change tool embodiment, a spring can be inserted into the end of the change slot, so that depressing the elongated change tool compresses the return spring. After manipulation, the return spring biases the change tool back to its first position out of engagement with the retainer cavity.

The programming key can then be removed from the keyway, rendering the lock in a reset configuration where each of the change members is disposed in the pin chamber between the driver and tumbler. In the reset configuration, the lock can be programmed for use with any user key, by inserting the new user key into the keyway and rotating the plug in the opposite direction toward the programming position. This allows any change ball raised above the shear line by the new user key to be deposited into its second position in the corresponding retainer cavity, thereby configuring the lock for operation by the new user key.

When the new user key is inserted, one or more of the other contour positions on the new user key raise one or more change members above the primary shear line. In the case where the change member is a spherical change ball, at least the centerpoint of the sphere must be raised above the shear line and into the driver chamber of the housing. The plug can then be rotated back in the opposite direction to the programming position, where any change member in a driver chamber is biased by the driver spring into the corresponding retainer cavities in the plug. This "reconfigures" the lock to operate with the new user key. The new user key can then rotate the plug to the first position, or on to the second, unlock position. Once returned to the first position, with the programming change member in its retainer cavity, the lock again will only rotate with the operable user key in the one direction to the second unlock position.

The user keys of the set of keys can be selected whereby the lock is operable with only one user key for a given lock configuration, and where another user key can only be made operable by reprogramming the lock configuration with the programming key. Typically, each user key differs from any other user key in the set of user keys in having a raised contour in a first contour position, a lowered contour in a second contour position, wherein the other user key has a lowered contour in the first contour position and a raised contour in the second contour position. It should be understood that "first contour position" and "second contour position" do not refer to the first and second pin chambers, but refer to any of the contour positions of the lock.

The user keys of the set of keys can also be selected whereby at least one key of the set is a successive user key that can be used to change the lock configuration, and to operate the lock, simply by use of the key. The successive user key also cancels the operation by the preceding user key. The preceding user key and the successive user key are complementary in that the successive user key has raised contour positions corresponding to the raised contour positions of the preceding user key, but are different in that the successive user key has at least one additional raised contour position. That is, the preceding user key can have no raised contour positions, or at least one raised contour position, and the successive key has a configuration similar to the preceding key, but also has a at least one additional raised contour position.

A first embodiment of a changeable lock assembly of the present invention is shown in FIGS. 1 through 24. This embodiment shows a changeable lock assembly that can be programmed to operate with one of a plurality of user keys. The changeable lock operates with a user key to rotate in one direction from the initial key-insertion position to un-lock an associated latch or bolt (i.e., to open the lock) and in an opposite direction to lock the latch or both (i.e., to lock the lock). The lock requires a change tool to reconfigure or program the lock for a different user key. The embodiment lock also can be programmed only with the use of a programming key.

Figure 2:
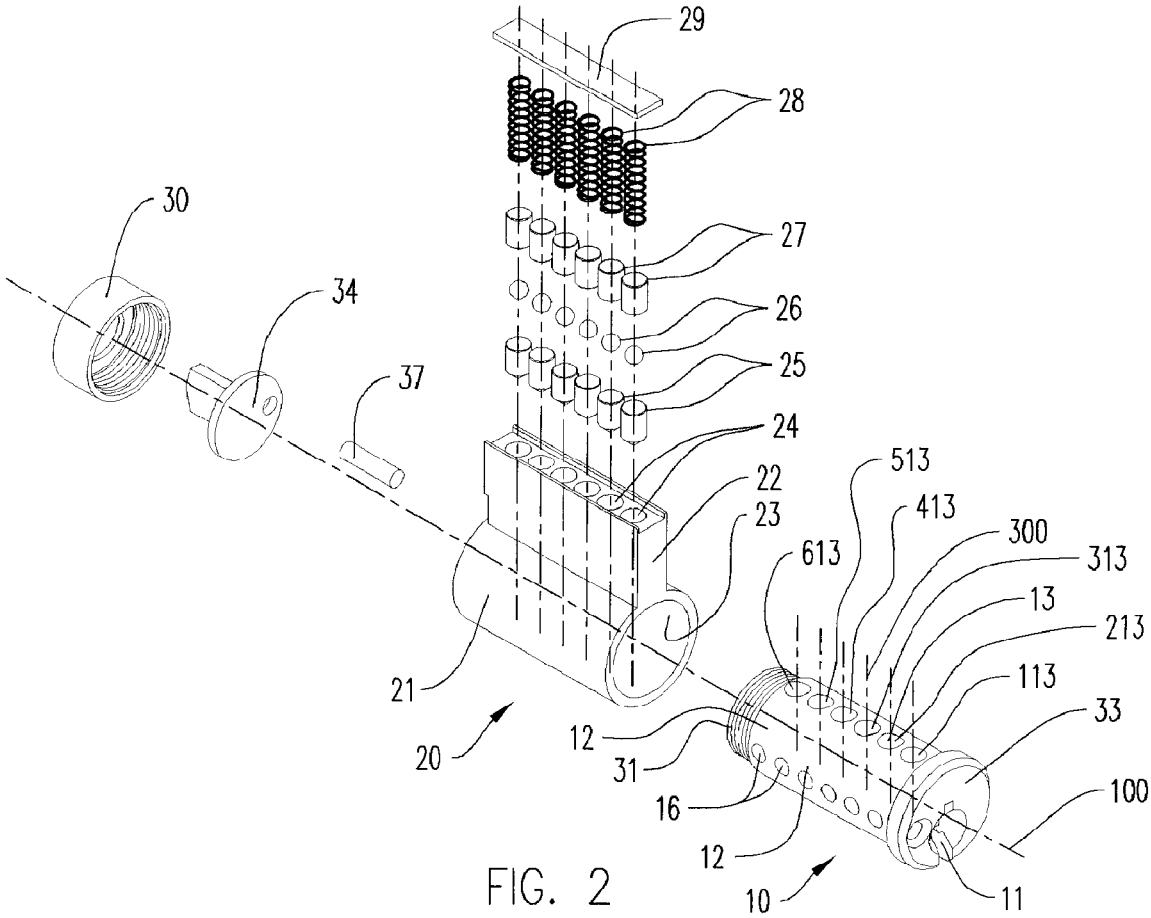
FIG. 2 shows an exploded perspective view of the components of an embodiment of a programmable lock of the present invention including a housing and a plug.

FIGS. 1 and 2 show the lock assembly that includes a housing 20 having a cylindrical barrel portion 21 and a stack portion 22. The barrel portion 21 has a cylindrical bore that runs through the length of the barrel portion 21 to form an inner surface 23. A plurality of driver chambers 24 are formed along the length of the stack portion 22, and intersect the inner surface 23. In an illustrated embodiment, each of the driver chambers 24 has substantially the same diameter, and are aligned along the centerline 100 that passes through the longitudinal center of the barrel portion 21. The plurality of driver chambers 24 corresponding to the first through sixth pin chambers are denoted, starting at the face of the plug and progressing rearward, as driver chambers 124, 224, 324, 424, 524 and 624, respectively.

The plug 10 of the lock has a cylindrical periphery 12 that is formed or machined to allow the plug 10 to be mounted rotatably within the inner surface 23 of the housing, such that the centerline of the plug is aligned along the centerline 100 for the housing barrel 21. A cylindrical shear surface is formed at the interface between the periphery 12 of the plug 10 and the inner surface 23 of the housing 20. A shear line or arc 19 forms a portion of the shear surface, at the intersection of the driver chambers 24 with the bore 23 (see FIG. 9).

The lock 1 operates under the well-known principle that, provided none of the lock hardware (the lock drivers and tumblers, discussed hereinafter) span across the shear line or shear arc 19, then the plug 10 is free to rotate within the bore, and the lock operates to open a latch, a bolt or other means of securing a door or other device being secured closed by the lock. On the other hand, if a driver or a tumbler spans across the shear line 19, then the plug 10 is prevented from rotating within the bore.

Figure 7:
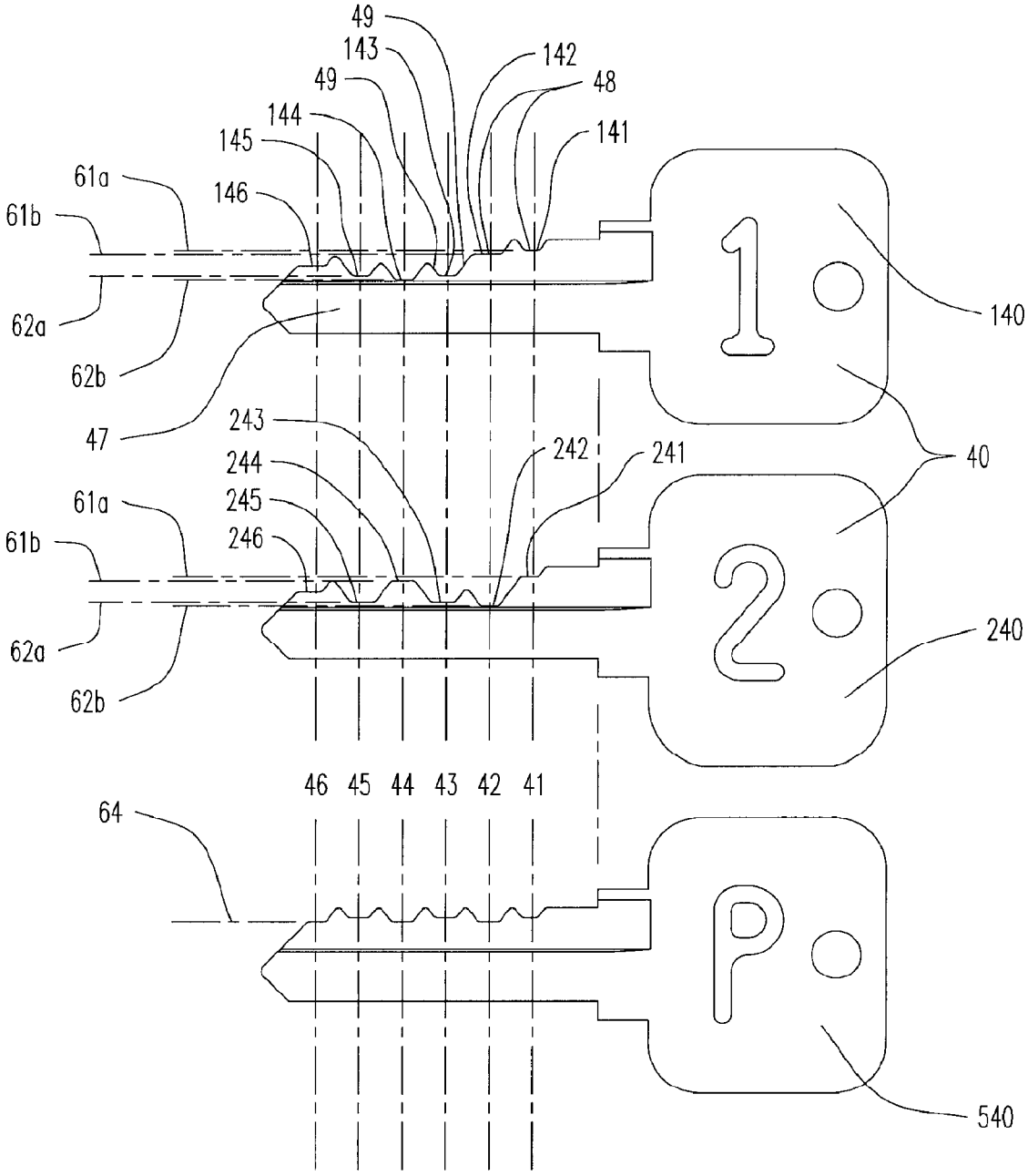
FIG. 7 shows a partially cut-away, perspective view of the programmable lock with the first user key inserted.
Figure 7:
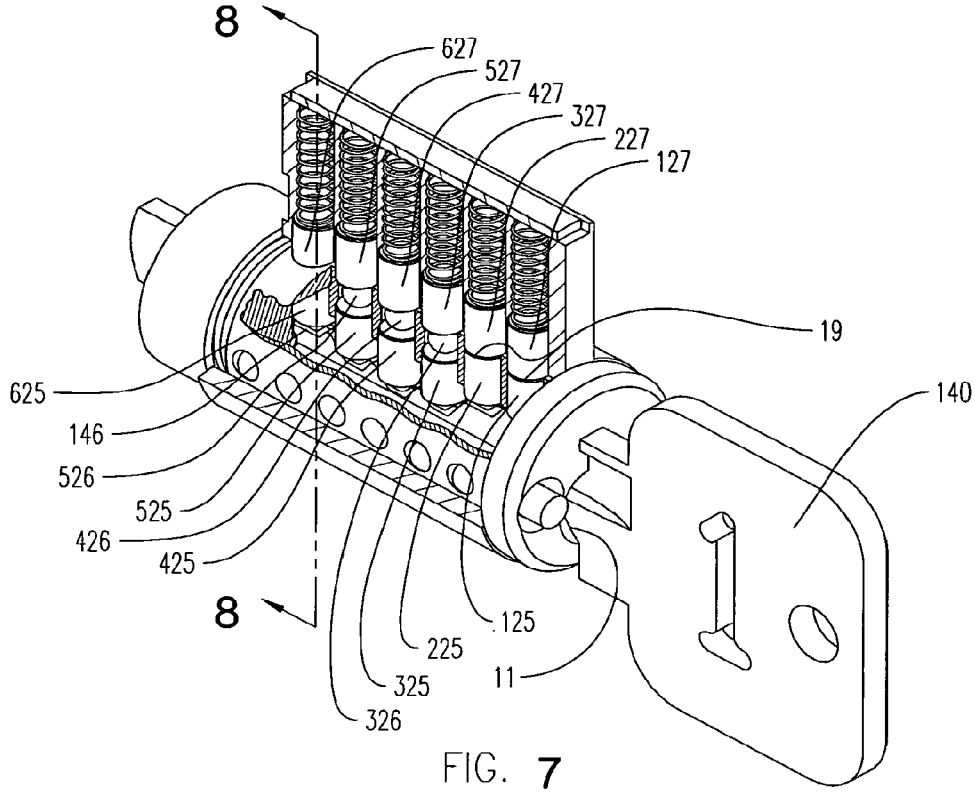
Figure 8:
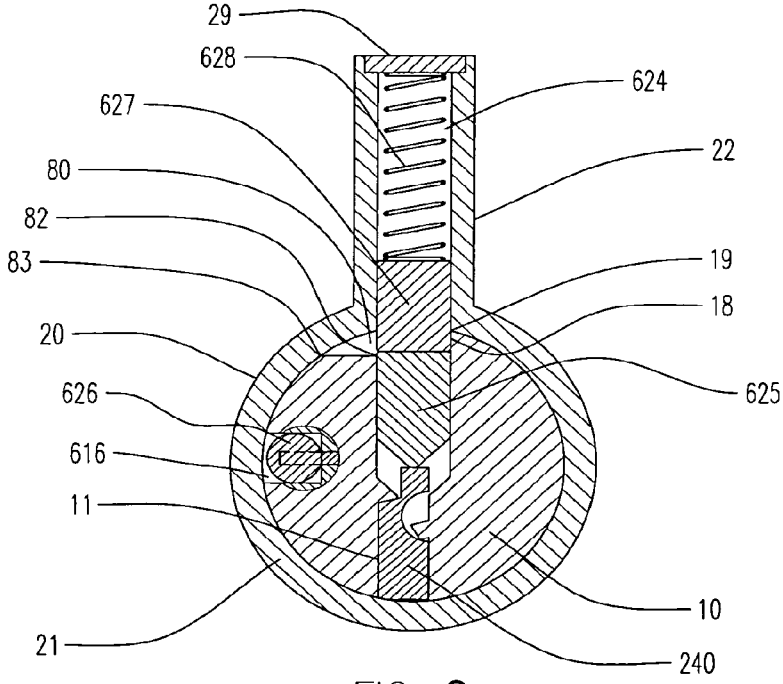
FIG. 8 is a sectional view of the lock with the first user key inserted, taken through line 8-8 of FIG. 7.

The plug 10 has a keyway 11 which has been bored or machined out of the plug 10 to provide a passageway for an associated key 40, such as one of the keys shown in FIG. 7. Typically, the keyway 11 extends longitudinally from the front face 33 of the plug toward the rear. The cross sectional shape of the keyway 11 typically remains constant along the longitudinal axis 100 of the plug 12, and is configured to receive a corresponding shaft portion 47 of a key 40 that has a complementary cross sectional shape along its longitudinal length, as is well-known and practiced in the conventional lock industry.

Figure 3:
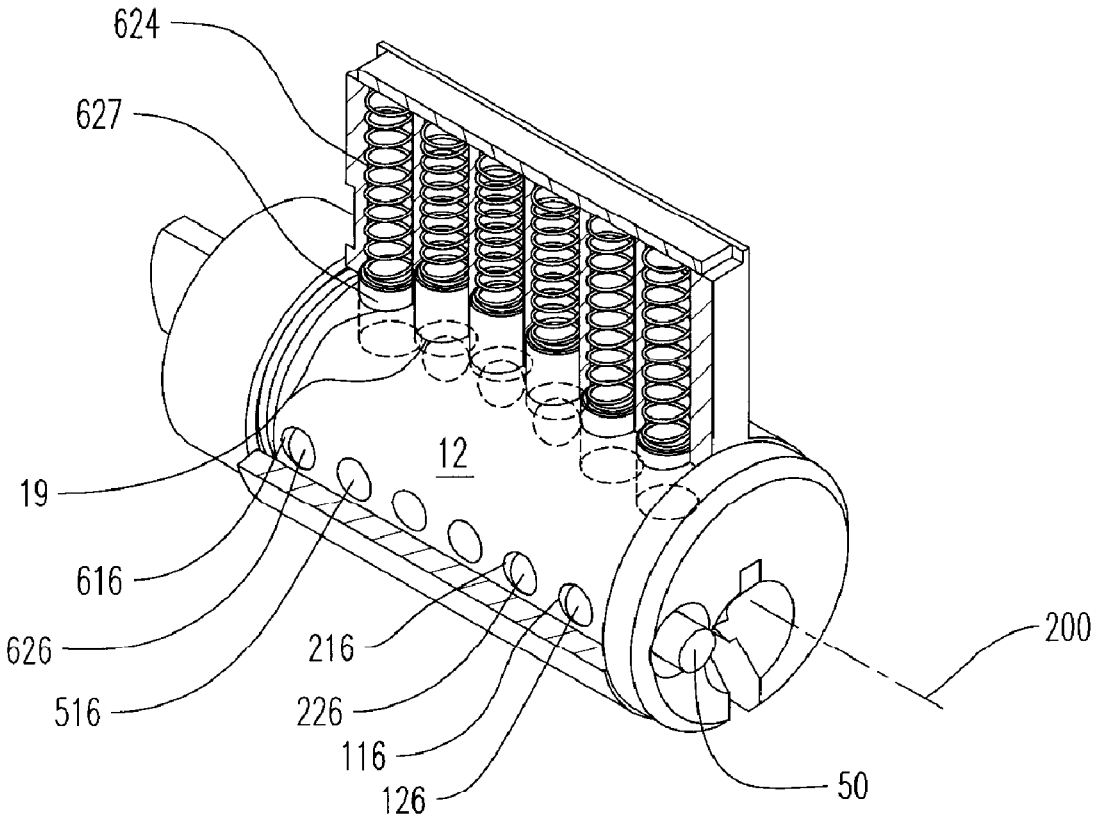
FIG. 3 shows a perspective view of the programmable lock with partially cut-away of the housing.

The plug 10 comprises a plurality of tumbler chambers 13 that penetrate from the plug periphery 12 through the body of the plug 10 to intersect the keyway 11. The tumbler chambers 13 lie generally in a plane that extends through the keyway 11. As shown in the illustrated embodiment, the tumbler chambers 13 are generally of the same diameter, and are equally spaced and aligned along the longitudinal length of the plug 10. Each tumbler chamber 13 is formed or machined along a separate centerline 300 that intersects and is perpendicular to the centerline 200 of the plug. When the tumbler chambers 13 of the plug 10 are axially aligned with the driver chambers 24 of the stack portion 22, generally as shown in FIG. 3, the plug 10 is in a first rotated position with respect to the housing 20. The plurality of tumbler chambers 13 corresponding to the first through sixth pin chambers are denoted, from front to rear, as driver chambers 113, 213, 313, 413, 513 and 613, respectively.

The latch or rear end of the plug can be provided with a means of securement of the plug with the housing. One means for securement comprises threads, shown as machined threads 31, which can extend from the rear end of the housing 20 and receive a correspondingly-threaded cap 30 to secure the plug 10 within the housing 20. A latch 34 can be retained by the cap 30 for engaging a recess or bolt (not shown) to unlock the object, such as a door, cabinet, padlock, etc., in which the lock is installed. Another mean of securement of the plug to the housing (not shown) can be a flange or plate, that is secured to rear face of the plug, such a cam plate that is secured with a fastening screw. Rotation of the plug causes rotation of the cam plate.

The lock 1 also comprises a plurality of lock hardware elements, comprising a plurality of tumblers 25, drivers 27, driver springs 28, and change members 26. Typically, each pin chamber, formed from an aligned tumbler chamber 13 and driver chamber 24 when the plug 10 is in its first rotated position, comprises, in sequence, one tumbler 25, one change member 26, one driver 27 and one driver spring 28. The tumblers 25 are generally pencil-shaped, consisting of a cylindrical body with a tapered or conical end. Each tumbler 25 is moveable axially along and within the tumbler chamber 13, and positioned with the tapered end extending into the keyway 11 when no key is inserted. In the illustrated embodiment, the plurality of tumblers 25 corresponding to the first through sixth pin chambers are denoted as tumblers 125, 225, 325, 425, 525, and 625, respectively.

Each driver 27 is positioned within driver chamber 24 of the stack portion 22 of the housing, and is moveable axially along and within the driver chamber 24. The driver 27 typically has a cylindrical body. A driver spring 28 biases the driver 27 toward the shear line 19 and inner surfaces 23 of the housing 20. The plurality of drivers 27 corresponding to the first through sixth pin chambers are noted as drivers 127, 227, 327, 427, 527, and 627, respectively. The driver spring 28 is typically made of a tempered stainless steel to prevent material deformation upon multiple cycles of compression and extension. Preferably, the spring material is a non-metallic stainless steel wire of about size 008, and is available as part number C108x008x520 from W.B. Jones Spring Co., Inc., of Wilder, Ky. A planar lid 29 can be secured in position to the top of the stack portion 22 to retain the hardware elements after these have been loaded into the pin chambers.

The change member 26 is illustrated as a spherical ball. The spherical shape of the change member 26 allows rolling movement within the driver chambers 24, tumbler chambers 13, and other passageways in the lock, and projects the same cross-sectional shape (circular) regardless of its orientation. The spherical shape of the change member 26 eliminates corners or edges that can obstruct its free movement. A barrel- or cylindrical-shaped change member can be used in a lock of the present invention, although it may have a tendency to tilt or tumble within a chamber, which can increase the potential of becoming lodged within the chamber and jamming the lock. For the purpose of describing succeeding embodiments of the present invention, the change member will hereinafter be referred to as the change ball 26.

As shown in FIGS. 1 and 3, the plug 10 has a plurality of retainer cavities 16 machined into the body of the plug 10 through the plug periphery 12. The retainer cavities 16 are of substantially the same circular cross section, and are shown aligned along and disposed perpendicularly to the longitudinal axis 200 of the plug. The plurality of retainer cavities 16 are equally spaced, whereby each retainer cavity 16 is axially aligned and circumferentially displaced from the tumbler chambers of the plug 10, the top edges of which are shown as shear arcs or shear lines 19. Typically the diameter or minimum opening of the retainer cavity is larger than, and typically just slightly larger than, the diameter of the change ball 26. The depth of the bore or cavity of the retainer cavity 16 from the periphery 12, is at least as deep as, and typically deeper than, the diameter of the change ball. The plurality of retainer cavities 16 corresponding to the first through sixth pin chambers are denoted as retainer cavities 116, 216, 316, 416, 516, and 616, respectively.

Figure 4:
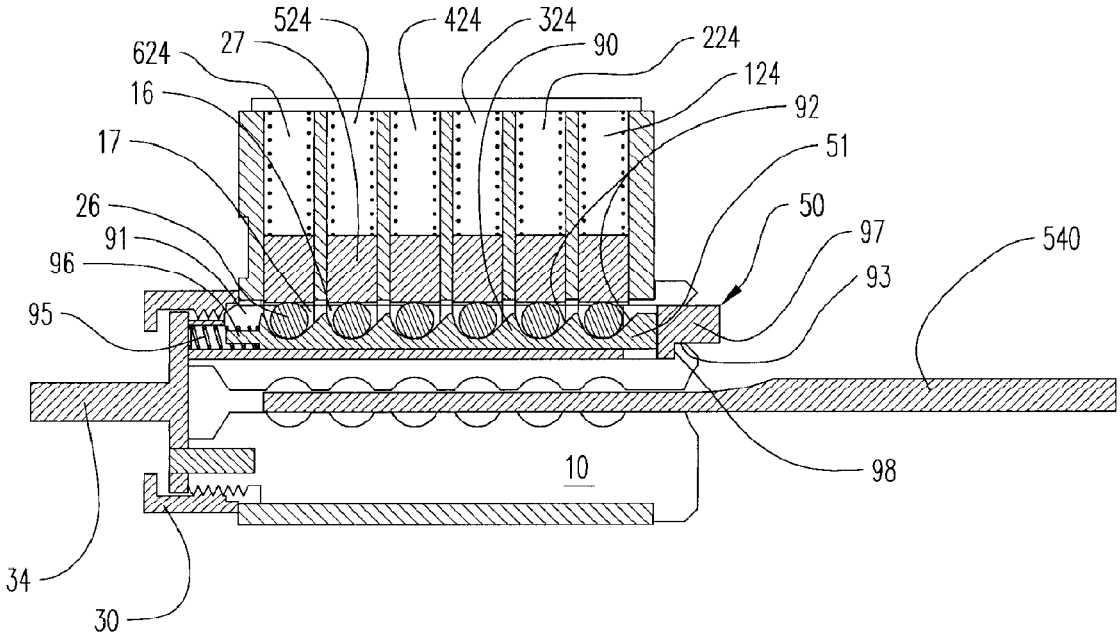
FIG. 4 shows a cross sectional view of the lock of FIG. 14, taken through line 4-4, showing an integral change tool in a first position.
Figure 5:
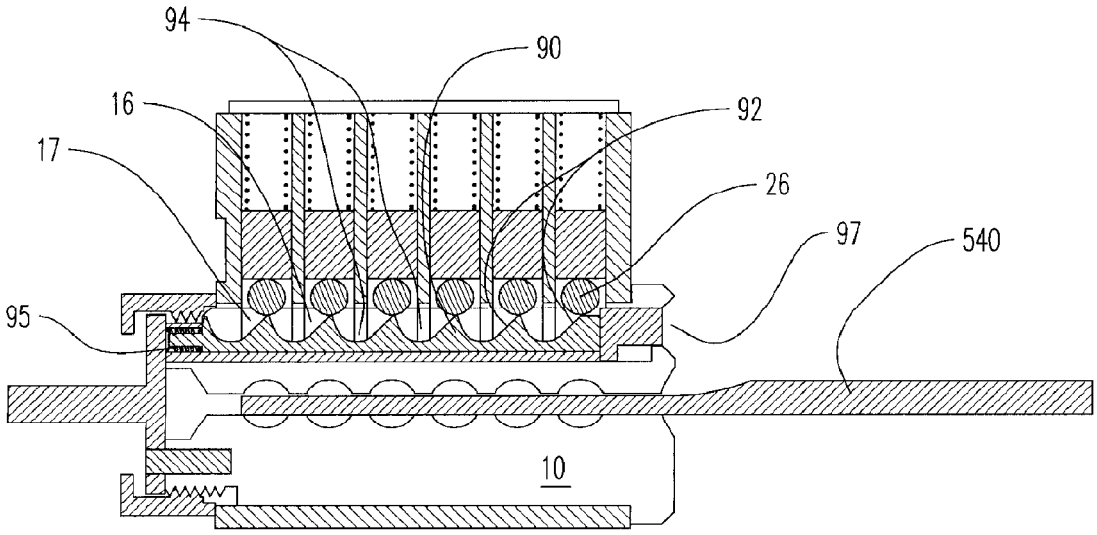
FIG. 5 shows a cross sectional view of the lock of FIG. 15, taken through line 5-5, showing the integral change tool manipulated into a second position.

Shown in FIGS. 4 and 5 is change tooling 50, disposed in a change slot 17 that is formed into the body of the plug 10, parallel to the axial centerline 200. The change slot 17 extends from proximate the front face 33, to proximate the rear end of the plug. The change slot 17 passes generally proximate to the plurality of retainer cavities 16. In the illustrated embodiment, the change slot 17 is formed through the centers of the aligned retainer cavities 16. The radial depth of the change slot 17 substantially overlaps the depth of the retainer cavities 16. The width and height of the change slot 17 are configured to accommodate a blade 51 of a change tool 50. The configuration of the change slot allows the axial manipulation of the change tool to raise a change ball 26 contained within the retainer cavity 16 at its center of weight and to a height within the retainer cavity that is sufficient to cause the change ball 26 to be moved out of the retainer cavity. The change slot 17 is typically configured with a minimum width, while maintaining effective lifting of the change balls 26. A typical width of the change slot 17 is about 0.020 inches (about 0.50 mm) or less.

The change tool 50 is shown with a plurality of valleys or voids 94, intermittent a plurality of peaks or raised position 90 that serve as biasing members. The voids 94 are configured to register with a corresponding retainer cavity 16 when the change tool is in its first position, shown in FIG. 4. The raised portions 90 are configured to register with the corresponding retainer cavity 26 when the change tool is in its second position, shown in FIG. 5. In the illustrated, the change tool is shown biased into its first position by a biasing spring 95 disposed between the rear end 96 of the change tool and the latch 34. The change tool 50 can be manipulated into its second position by depressing front button 97 with a finger or other implement. As illustrated, any change ball disposed within the retainer cavity can be moved out of the retainer cavity and into its corresponding driver chamber 24 when the change tool button 97 is depressed. Depressing button 97 causes the slanted biasing surface 92 of each raised portion 90 of the change tool to force the change ball 26 outward and against the inner wall of the retainer cavity 16. As the biasing surface 92 of the change tool proceeds further into the retainer cavity, the change ball is lifted higher within the retainer cavity. When the change tool is fully depressed, as shown in FIG. 5, the change balls has raised at least mostly, and preferably completely, out of the retainer cavity, and into the respective drive chamber. When the plug 10 is rotated from the programming position (its second rotated position) back toward the first rotated position, the change ball is captured within the drive chamber.

Referring to FIG. 7, the change ball 26 is typically positioned within the lock 1 in either a first position, disposed within a pin chamber between a driver 27 and a tumbler 25 as shown for the third, fourth and fifth pin chambers, or in a second position within a retainer cavity 16 as shown for the first, second and sixth pin chambers. During operation of the lock and in response to the reprogramming of the lock, the change ball 26 can be moved from its first position in the pin chamber to its second position in a corresponding retainer cavity 16. As shown in FIG. 1, each pin chamber (that is the first, second, third, fourth, fifth and sixth pin chambers) has one change ball 26 associated therewith. In alternative embodiments of the invention, one or more of the pin chambers can be configured without a change ball 26. When positioned within the pin chamber 18, the change ball 26 can reside in either the tumbler chamber 13 or in the driver chamber 24. Transfer of the change ball from its first position in the pin chamber 18 to its second position in the retainer cavity 16 typically involves movement of the change ball 26 from the tumbler chamber 13 into the driver chamber 24 when the plug 10 is in its first rotated position, typically by insertion of a programming key, and then from the driver chamber 24 into the retainer cavity 16, provided that the plug 10 can be rotated to its second rotated position.

Conversely, when the plug 10 is in its second rotated position, a change ball 26 can be moved from its second position within the retainer cavity 16 back into a driver chamber 24 when biased there from by manipulation of the change tool 50 in the change slot 17.

The lock 1 is associated with a set of keys 40, a subset portion of which is illustrated in FIG. 7. The subset of keys 40 can include a first user key 140, a second user key 240, and a programming key 540. Each of the keys has a shaft portion 47 having a contour edge that comprises a plurality of contour landings 48 that define a plurality of contour positions. In the illustrated embodiment, the contour edge has one contour position corresponding to each of the pin chambers of the lock 1. Each contour landing 48 is generally flat and parallel with the axis of the key shaft 47. When any of the keys 40 are inserted fully into the keyway 11 of the plug 10, the first through sixth contour positions, identified as contour positions 41, 42, 43, 44, 45, and 46, align with the first through sixth pin chambers of the lock. The shaft 47 of a key 40 can be formed or machined to a specific depth at each contour position. The length of each contour landing 48 should be sufficiently long to prevent a tumbler 25 from beginning to descend or ascend prematurely off the end of the contour landing 48 when inserting or withdrawing the key 40 from the keyway 11. At the same time, the sloped transition portions 49 between adjacent contour landings 48 should be sufficiently shallow in slope to allow the plurality of positioned tumblers 25 to run up and down the length of the contour of a key 40 as the key is being inserted into or withdrawn from the keyway 11.

In the illustrated embodiment, the six contour positions 41, 42, 43, 44, 45, and 46 for the first user key 140 are denoted as 141, 142, 143, 144, 145, and 146, respectively, for the second user key 240 as 241, 242, 243, 244, 245, and 246, and likewise for a master key and the programming key 540.

As is well known in the lock industry, the depth of a contour cut is typically made in relation with the height of the tumbler in the corresponding pin chamber. In the present invention, the depth of the cut (or said differently, the height) of the contour is also made in relation to the diameter or height of the change ball 26 associated therewith. That is, if a particular key is intended to raise a change ball 26 above the shear line 19 of the lock, then that key's corresponding contour position should be cut to a shallow depth (a raised contour) accordingly, which can raise the change ball 26 above the shear line 19. In the illustrated embodiment, each user key 140 and 240 have a contour edge that can comprise one or more raised contours, shown as phantom lines 61*a* and 61*b*, one or more lowered contours 62*a* and 62*b*, or a combination of raised and lowered contours. In the present invention, the height of a particular contour position for a user key, for example user key #1 (140) or user key #2 (240), will indicate the key's ability to raise a change ball 26 above the shear line 19 within that particular pin chamber. For example, the second contour position 142 of first user key 140 has a shallow cut (a raised contour position 61*b*), and the second contour position 242 of the second user key 240 has a deep cut (a lower contour position 62*b*). The shallow cut (raised contour 61*b*) of the second contour position 142 of user key 140 will allow key 140 to raise any change ball 226 in the pin chamber above the shear line 19 and into second driver chamber 224. Conversely, the deep cut (lower contour 62*b*) of the second contour position 42 on the second user key 240 will be insufficient to raise the change ball 226 out of the second tumbler chamber 213. Also, the deep cut in the fourth contour position 44 (lowered contour 62*b*) of the first user key 140 does not allow that key to raise a change ball 426 out of the fourth tumbler chamber 413, whereas the shallow cut in the fourth contour position 44 (raised contour 61*b*) of second user key 240 is sufficient to raise the change ball 426 above the shear line 19 and into fourth driver chamber 424. These principles will be further illustrated in a description of the operation of the key herein after.

In the description above, it should be understood that a key configuration that raises the change ball 26 above the shear line 19 is also raising the top end of the tumbler 25 to the shear line. This ensures that the change ball is displaced into the driver chamber 24, and that no hardware member in the pin chamber spans the shear line so that the plug can rotate within the housing.

The operation of the lock of the present invention will now be illustrated. FIG. 3 shows the lock 1 of the present invention in a configuration wherein the lock is operable with a first user key 140. In this configuration, change balls 326, 426 and 526, corresponding to the third, fourth, and fifth pin chambers, are positioned within their respective pin chambers between corresponding tumblers 325, 425 and 525, and drivers 327, 427 and 527. The change balls 126, 226 and 626, corresponding to the first, second and sixth pin chambers are positioned within their respective second positions in the retainer cavities 116, 216 and 616.

Figure 9:
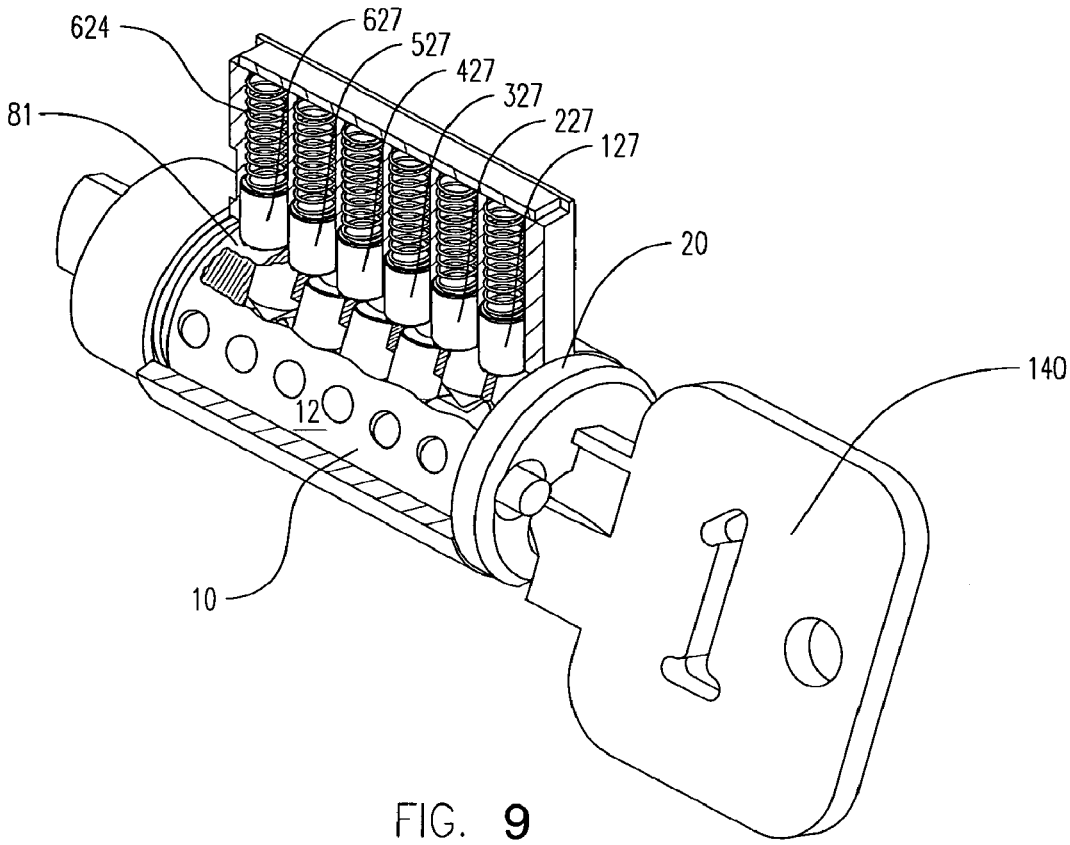
FIG. 9 shows the lock and key shown in FIG. 7, partially rotated to an unlock position.
Figure 10:
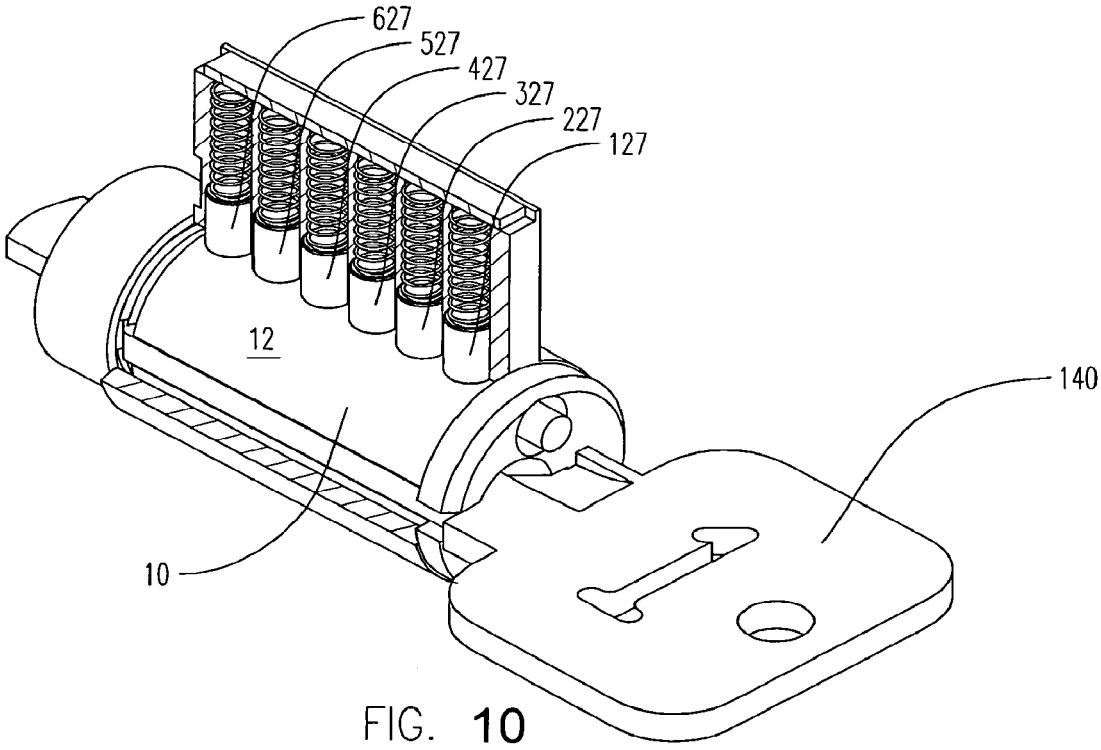
FIG. 10 shows the lock and key shown in FIG. 7, rotated to the unlock position.

As shown in FIG. 7 when a first user key 140 is inserted into the keyway 11, the first through sixth contour positions of the key raise corresponding tumblers 25 within the pin chambers. In the first, second and sixth pin chambers, the top ends of the corresponding tumblers 125, 225 and 625 are raised to the shear line 19, thereby also raising the bottom end of the corresponding drivers 127, 227, and 627 directly to the shear line 19. In the third, fourth and fifth pin chambers, the corresponding tumblers 325, 425 and 525 raise both the corresponding change balls 326, 426 and 526 and the corresponding drivers 327, 427 and 527, whereby the lower or bottom edge of each of the drivers 327, 427 and 527 is aligned with the shear line 19. Change balls 326, 426 and 526 remain in the respective tumbler chambers. It can be seen that the bottom edge of the driver and the top edge of the tumbler can be made slightly beveled to assist aligning and registering the driver or tumbler with the shear line. The lower end of each of the drivers 27 in the first through sixth pin chambers has been raised to the shear line primary 19. As the user key 140 is rotated clockwise (when facing the lock from the key side), the plug 10 can rotate within the bore of the housing 20 from its first position shown in FIG. 7, through the position shown in FIG. 9, and toward a second rotated position shown in FIG. 10. The second rotated position is typically the unlock position. As shown in FIG. 9, each of the drivers 127, 227, 327, 427, 527 and 627 in the first through sixth pin chambers will ride along the outer periphery 12 of the plug 10 as the plug is rotated toward its second rotated position. Rotation of the plug 10 to its second rotated position shown in FIG. 10 rotates the latch 34 associated with the lock 1 to the open or unlatched position.

Figure 11:
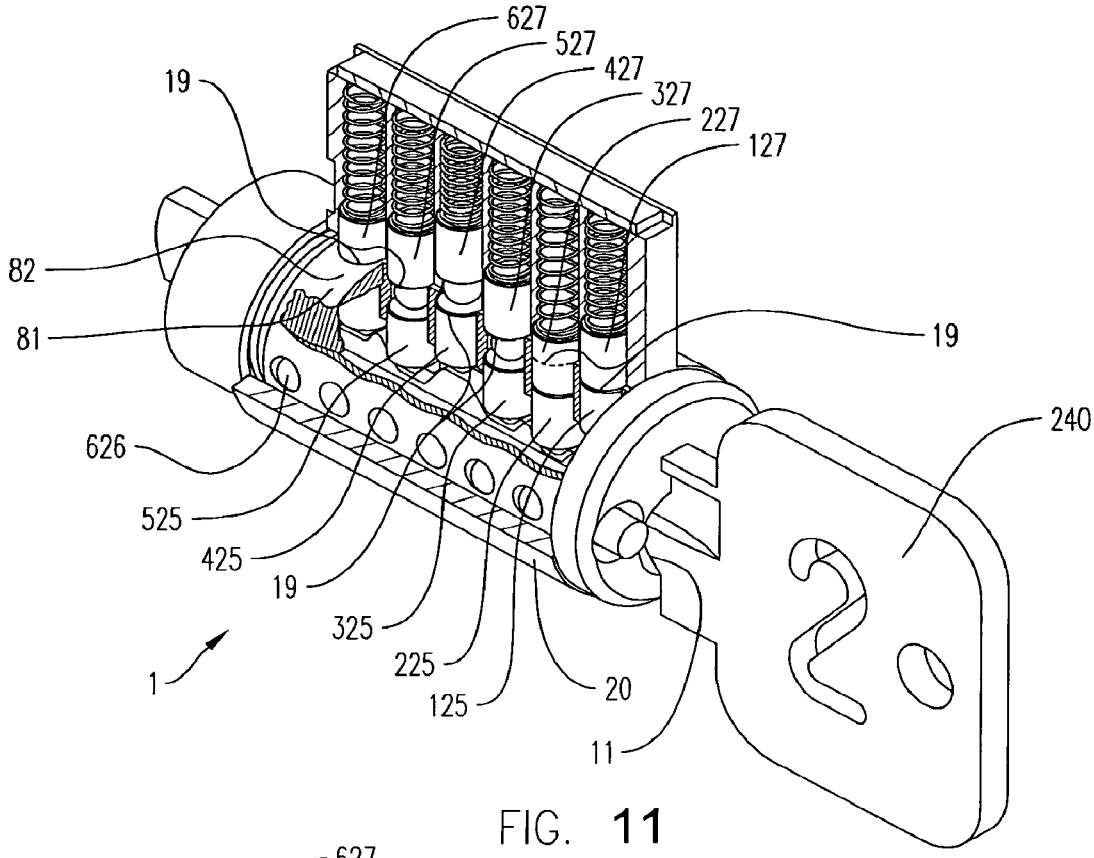
FIG. 11 shows a partially cut-away, perspective view of the programmable lock of FIG. 7, with a second user key inserted.

The first user key 140 can then be turned counterclockwise to rotate the plug 10 back to its first position, and can then be withdrawn from the keyway 11. As shown in FIG. 11, when a second user key 240 is inserted into a keyway 11, while the lock is configured for operation with the first user key, the lock 1 will not open with the second user key 240 inserted. In each of the third, fourth and fifth pin chambers, either the lower end of the drivers 327, 427 and 527 and/or the upper end of tumblers 325, 425 or 525 is positioned at the shear line 19, and therefore none of the bodies of these drivers or tumblers span the shear line 19. The raised contour 61*a* of the first and sixth contour positions 241 and 261 of the second user key 240 have raised the interfaces between the corresponding tumbler and driver to the shear line 19. However, since the second contour position 242 of the second user key 240 is a lowered contour 62*b* (see FIG. 6), and the corresponding change ball 226 is deposited in the second retainer cavity 216, driver 227 will span the shear line 19. Consequently, at least one of the drivers or tumblers, specifically driver 227, spans the shear line 19. The second user key 240 when inserted cannot raise the lower end of the second driver 227 to the shear line 19 when the lock is configured for operation with the first user key 140, and thus can not cause the plug 10 to rotate within the housing 20 when the lock is configured for operation with the first user key 140, and cannot operate the lock.

Figure 6:
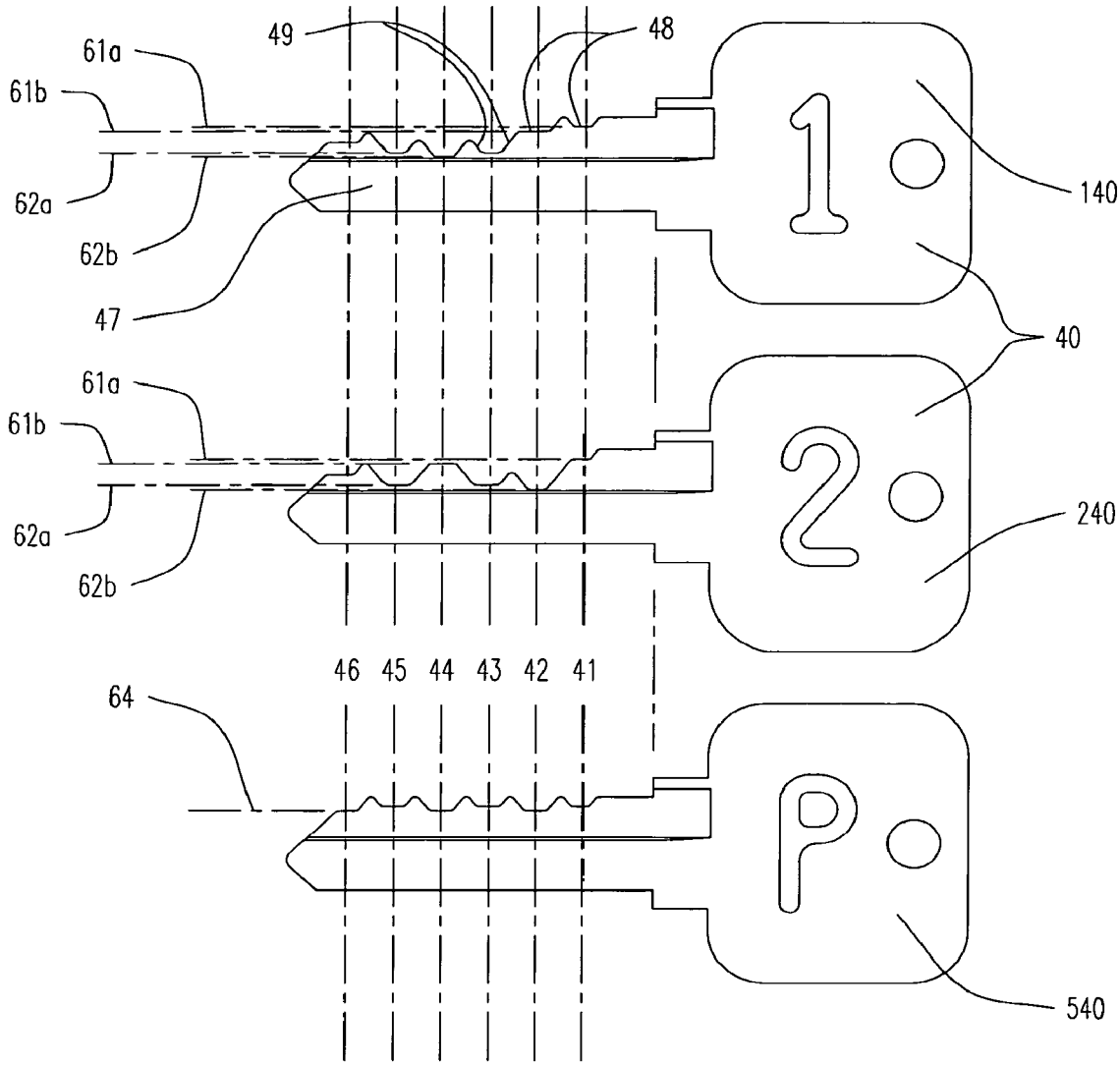
FIG. 6 shows a pair of user keys and a programming key, used with the lock.
Figure 12:
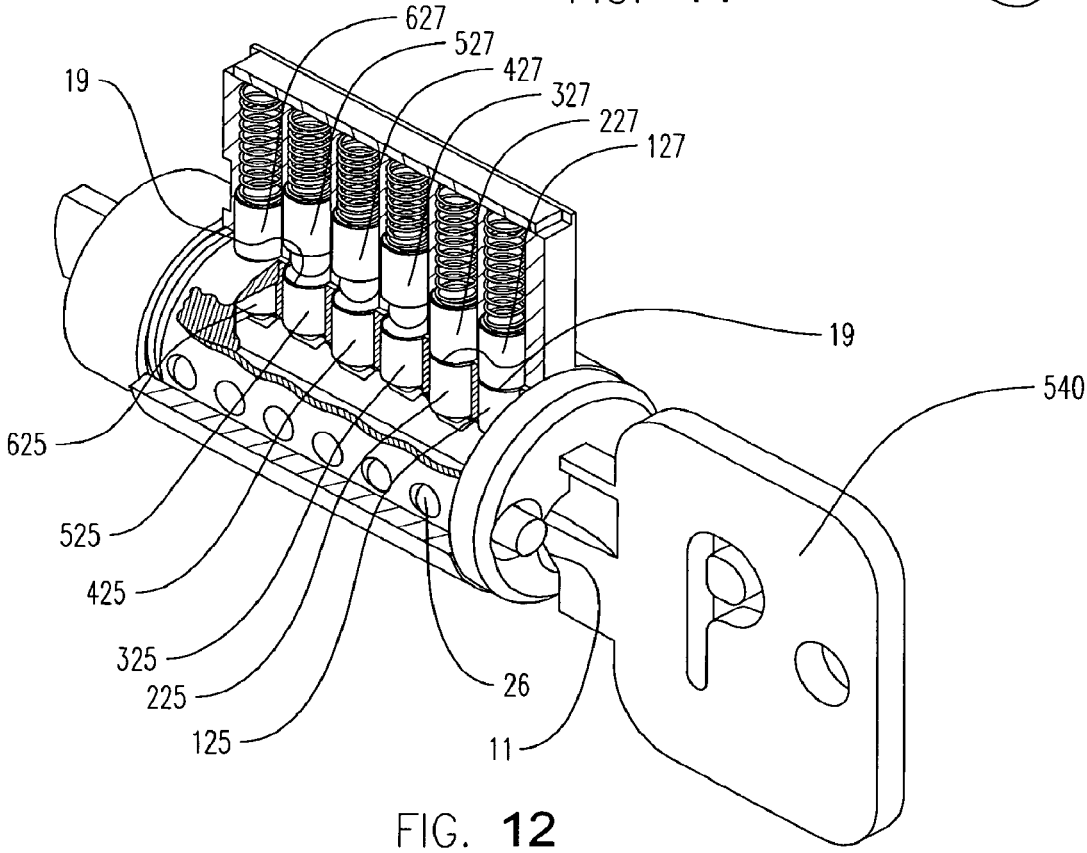
FIG. 12 shows a partially cut-away, perspective view of the programmable lock of FIG. 7, with a programming key inserted.

The lock is also configured to operate with a programming key 540, shown in FIG. 6 as key P. The use of the programming key 540 in the lock is illustrated in FIG. 12 to show reprogramming of the lock configuration from operation with the first user key 140 to operation with the second user key 240. In the illustrated embodiment, the programming key 540 is configured with contour positions 41 through 46 each having either of the raised contours 61*a* or 61*b*. When the programming key 540 is fully inserted into the keyway 11 of the lock that is programmed for any user key, including the first user key 140 or the second user key 240, the contour positions of the programming key 540 will raise the top of each of the tumblers 125, 225, 325, 425, 525 and 625 in pin positions 1 through 6 to the shear line 19, and moves each driver and any change ball in the pin chamber up into the driver chamber. None of the drivers and tumblers spans the shear line 19.

While in this position, the programming key 540 can be used to open the lock by rotation of the plug 10 in the counter-clockwise direction to the third rotated position, or to lock the lock by rotation of the plug 10 in the clockwise direction to the second rotated position.

Figure 13:
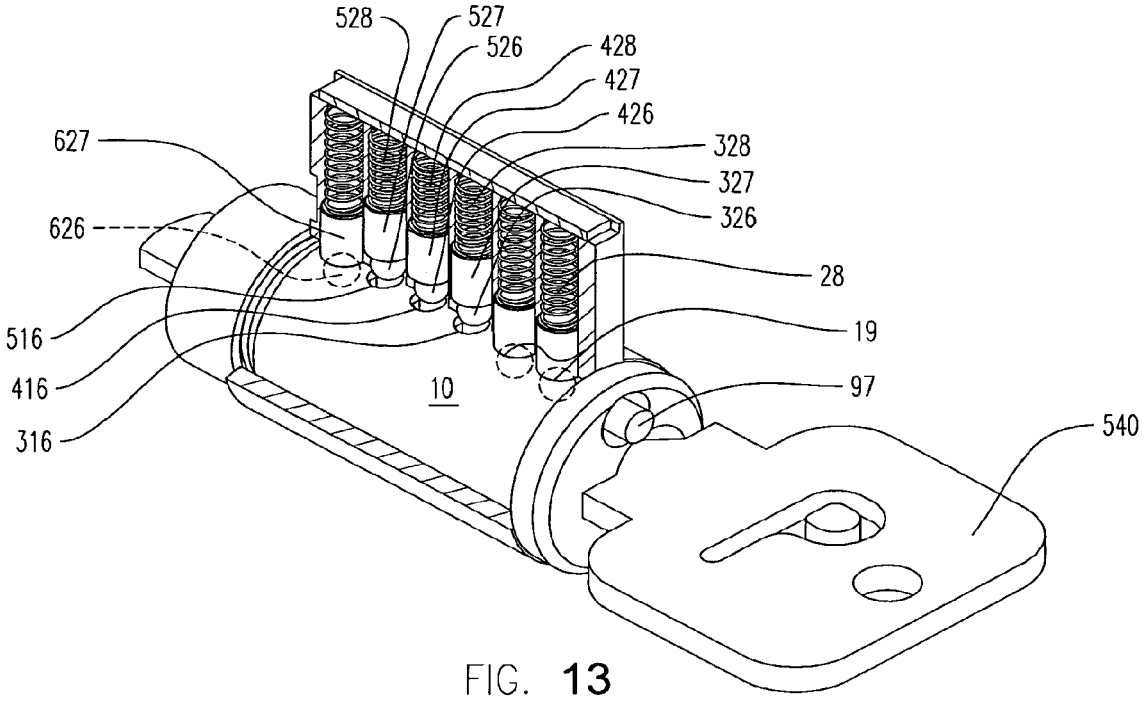
FIG. 13 shows the lock and key shown in FIG. 12, rotated to a programming position, with change members poised above their respective retainer cavities.
Figure 14:
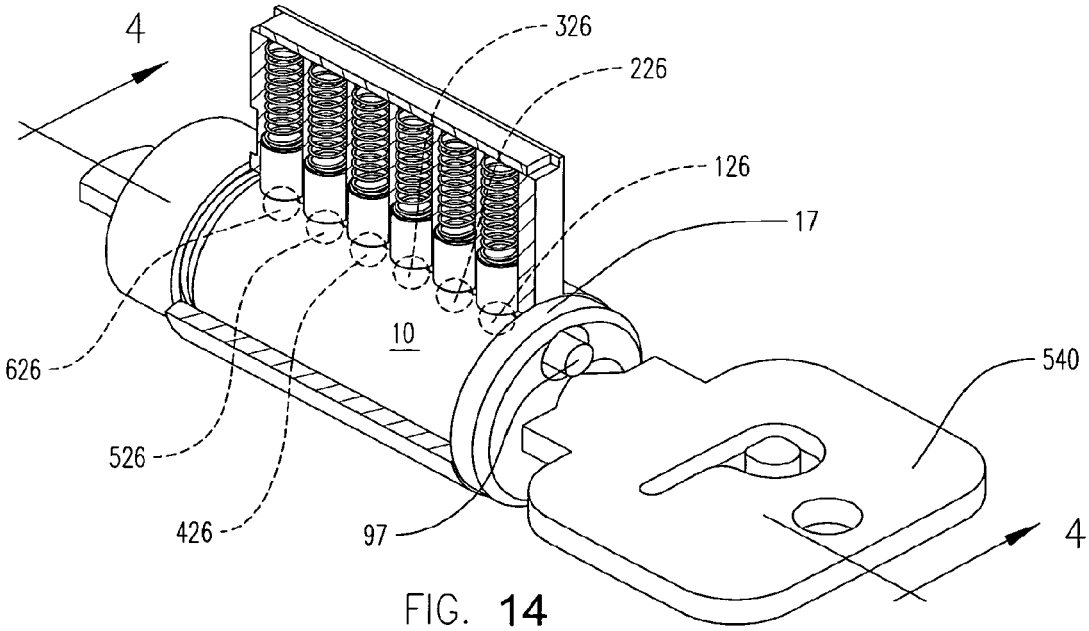
FIG. 14 shows the lock and key shown in FIG. 13, in the programming position, with change members deposited in their respective retainer cavities.

Importantly, rotation of the plug 10 by the programming key 540 to the second rotated position will reprogram the lock. FIG. 13 shows the programming key 540 turned in the clockwise position with the plug 10 in the second or reprogramming position. For illustration, each of the change balls 326, 426 and 526 in the third, fourth, and fifth driver chambers is shown positioned above each of their respective retainer cavities 316, 416 and 516, frozen at the moment when the plug 10 has been turned fully to the programming position. In real time, as soon as the plug 10 has been rotated approximately to the programming position, the driver springs 328, 428 and 528 above each of the drivers 327, 427 and 527 will thrust the corresponding change balls 326, 426 and 526 down into their corresponding retainer cavities 316, 416 and 516, as shown in FIG. 14. FIG. 14 shows the lock of the present invention in a reset position, with the plug 10 rotated to its programming position, and where each of the change balls 126, 226, 326, 426, 526, and 626 (shown in silhouette) is positioned within the respective retainer cavity 16. From this reset configuration, the lock of the present invention can be programmed for use with another user key. On the other hand, the programming key 540 can be rotated back to the first rotated position and removed. The lock is in the reset position, but cannot be operated by any of the user keys, but can be operated only by the programming key.

Figure 15:
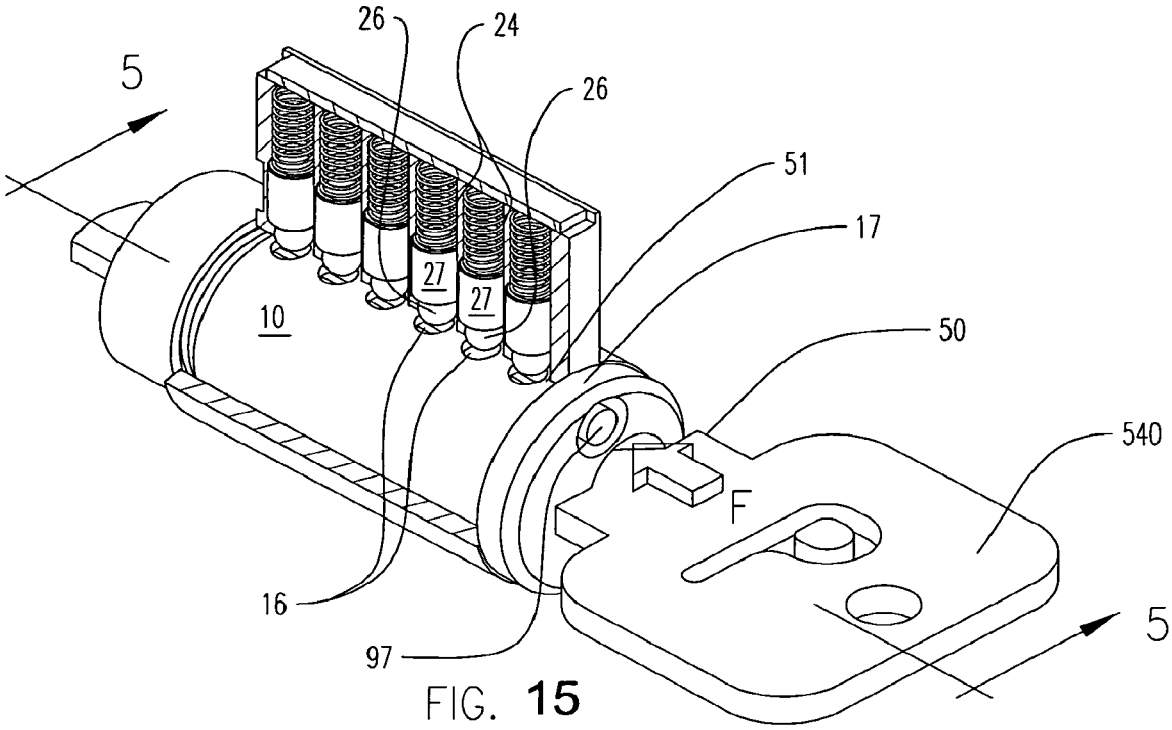
FIG. 15 shows the lock and key shown in FIG. 14, with the change tooling manipulated to its second position, to bias the change from their retainer cavities.
Figure 16:
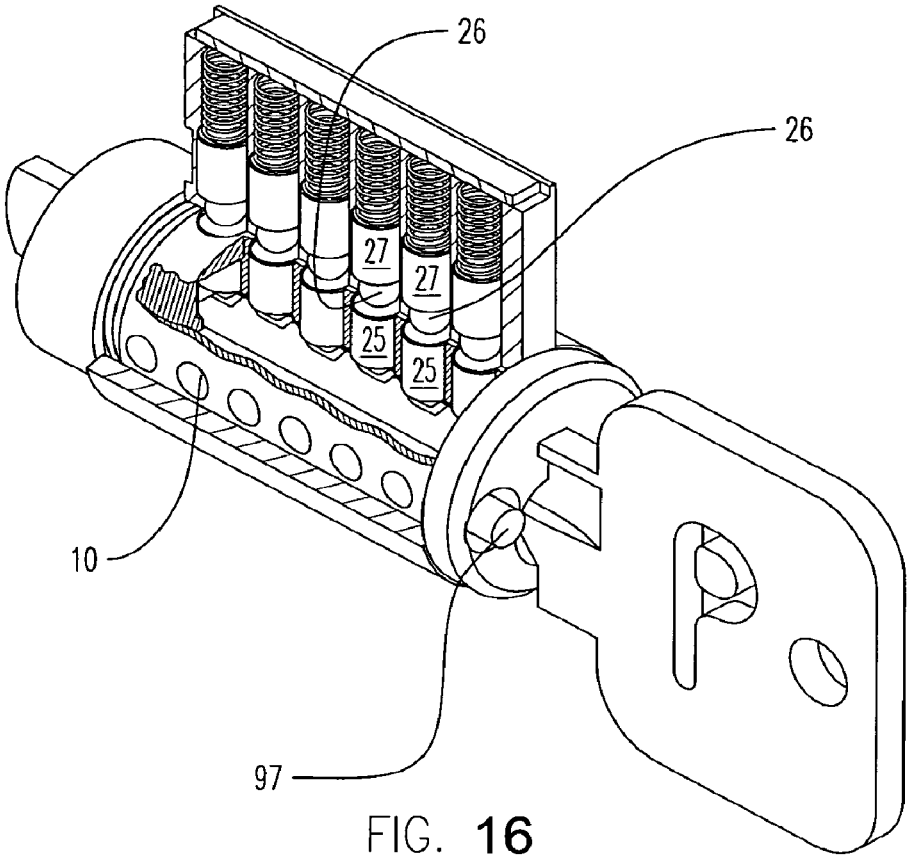
FIG. 16 shows the lock and programming key of FIG. 15, in the initial position and in a reset configuration with the change members in the pin chambers.
Figure 17:
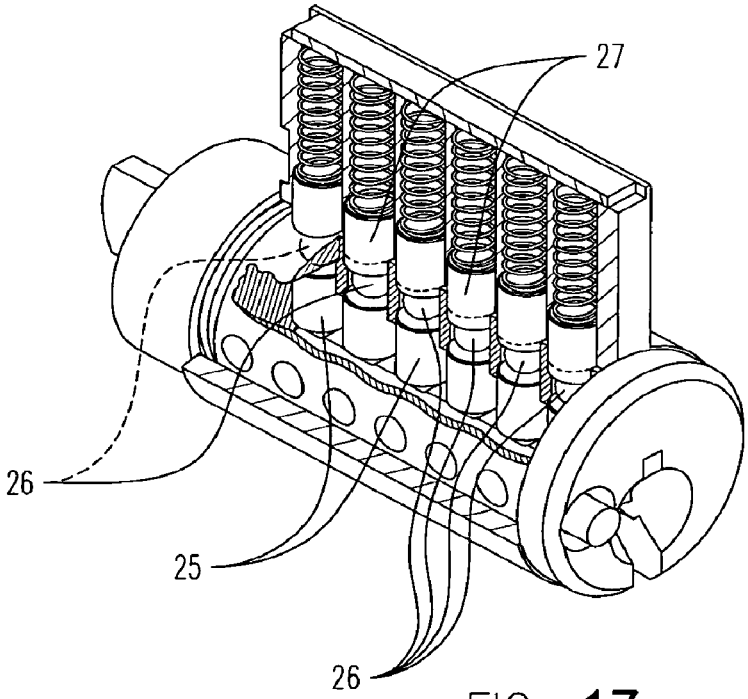
FIG. 17 shows the lock of FIG. 16, with the programming key removed.

As shown in FIG. 15, a change tooling 50 is used wherein the change tool blade 51 is manipulated within the change slot 17 formed in the plug 10. When the protruding button 97 of the change tooling is depressed, the change tool blade 51 is moved from its first or disengaged position shown in FIGS. 4 and 14, to its second or engaged position, shown in FIGS. 5 and 15. The slanted biasing surface 92 corresponding to each retainer cavity progresses into engagement with the change ball 26 disposed in the retainer cavity, and raises change ball to a height where, upon rotation of the plug 10 back to the first rotated position, the change ball is captured within pin chamber between its respective driver 27 and tumbler 25. The change tool 50 can then be released, wherein the return spring 95 biases the change tool 51 back to its first or disengaged position. The programming key 540 can then be withdrawn from the plug 10, rendering the lock shown in FIG. 17 in a null configuration. The null configuration of the lock has all of the change balls 26 disposed in the pin chambers between their respective tumblers 25 and driver 27.

Figure 18:
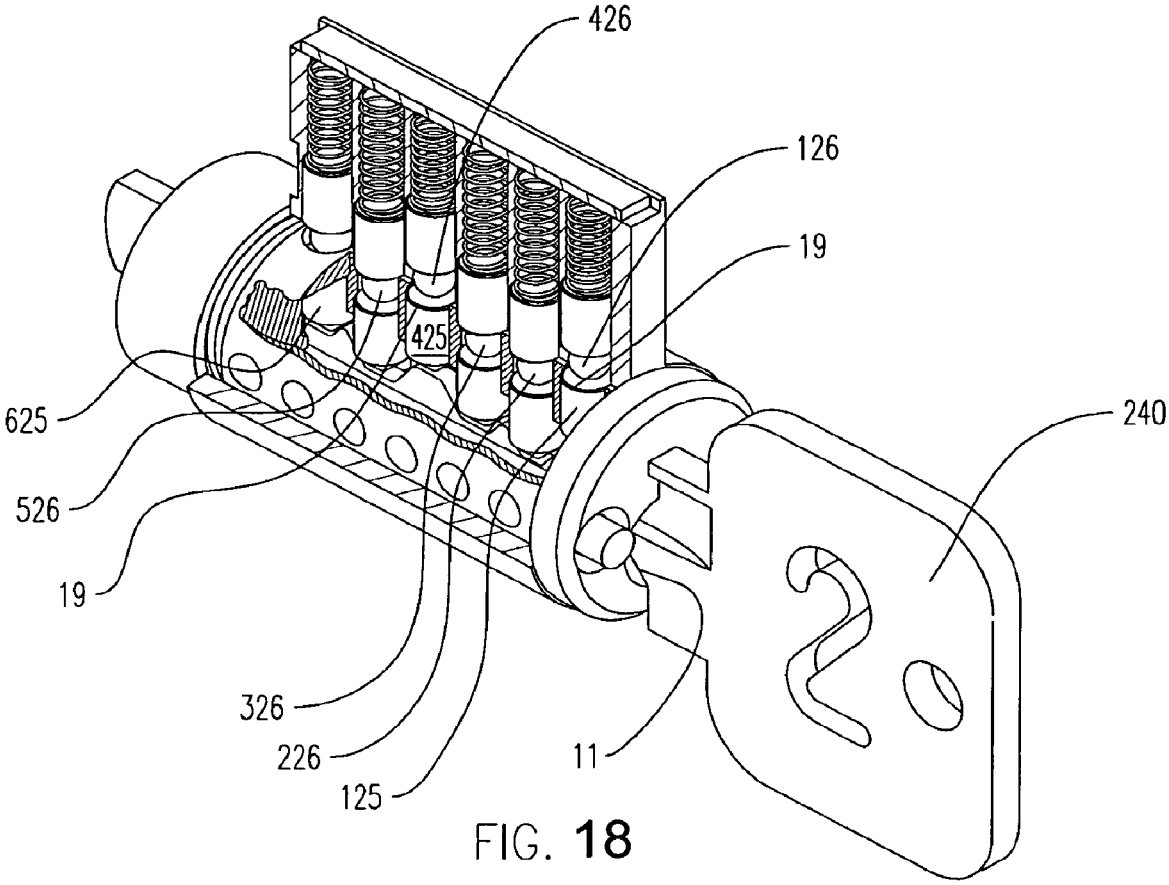
FIG. 18 shows the lock in reset configuration of FIG. 17, with a second user key inserted.
Figure 19:
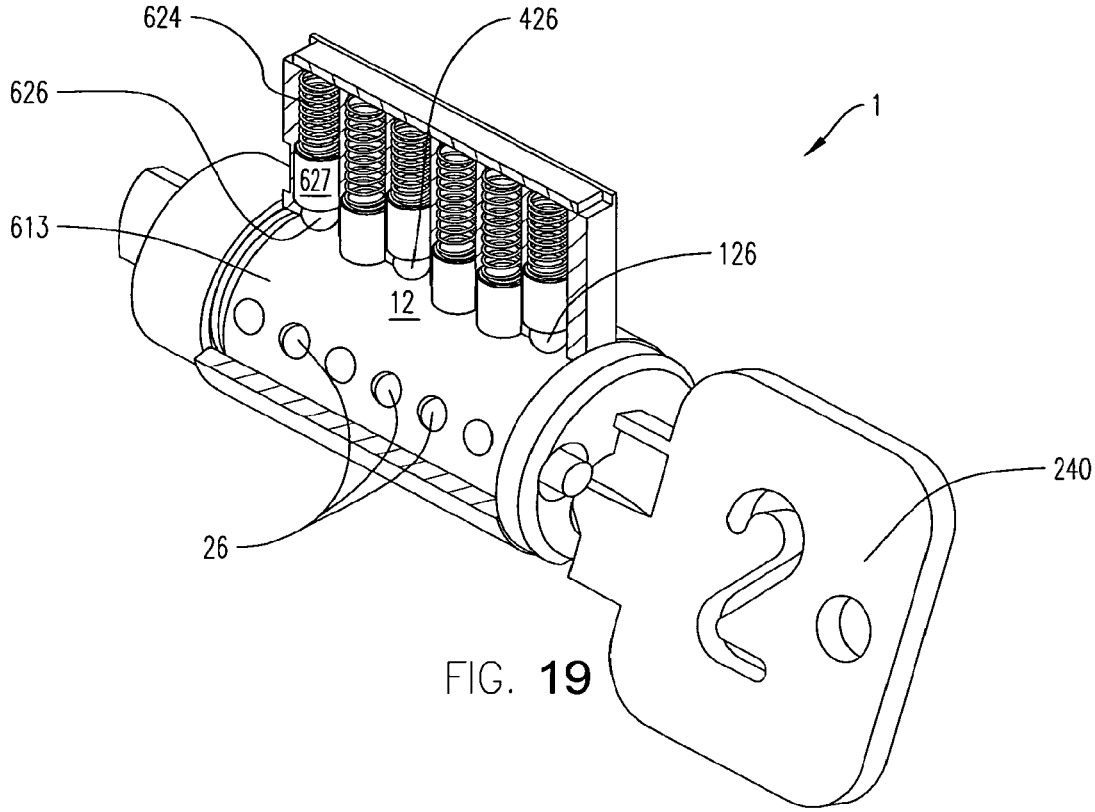
FIG. 19 shows the lock and second user key of FIG. 18, partially rotated back to the programming position.
Figure 20:
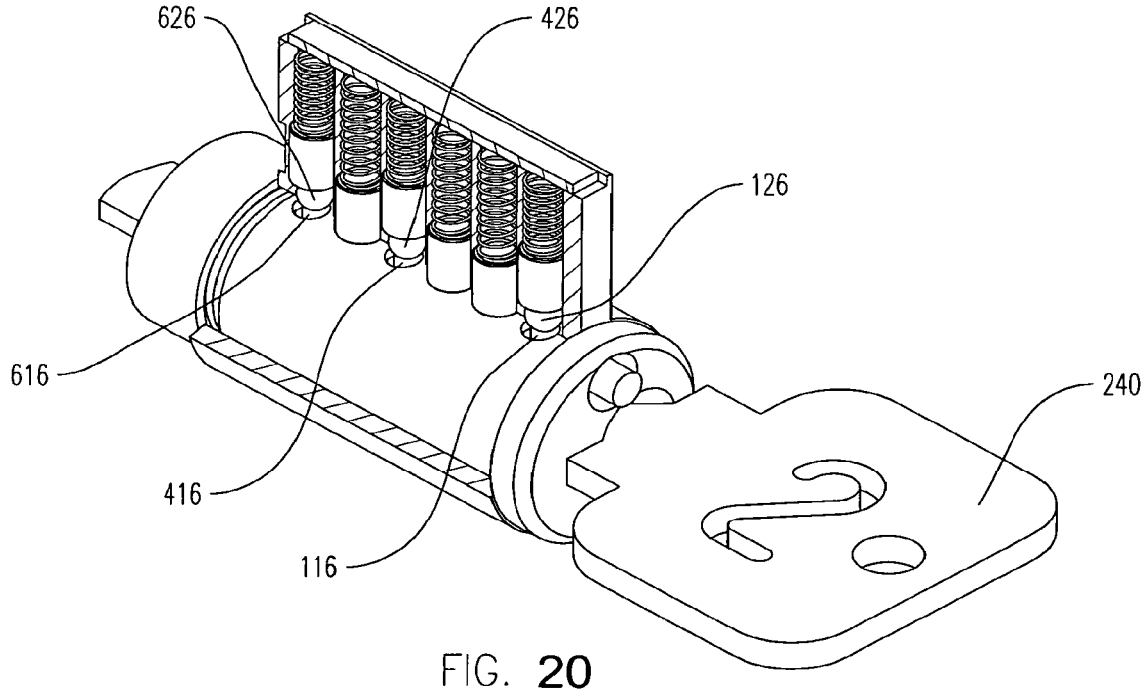
FIG. 20 shows the lock and second user key shown in FIG. 18, rotated to a programming position, with change members poised above their respective retainer cavities.
Figure 21:
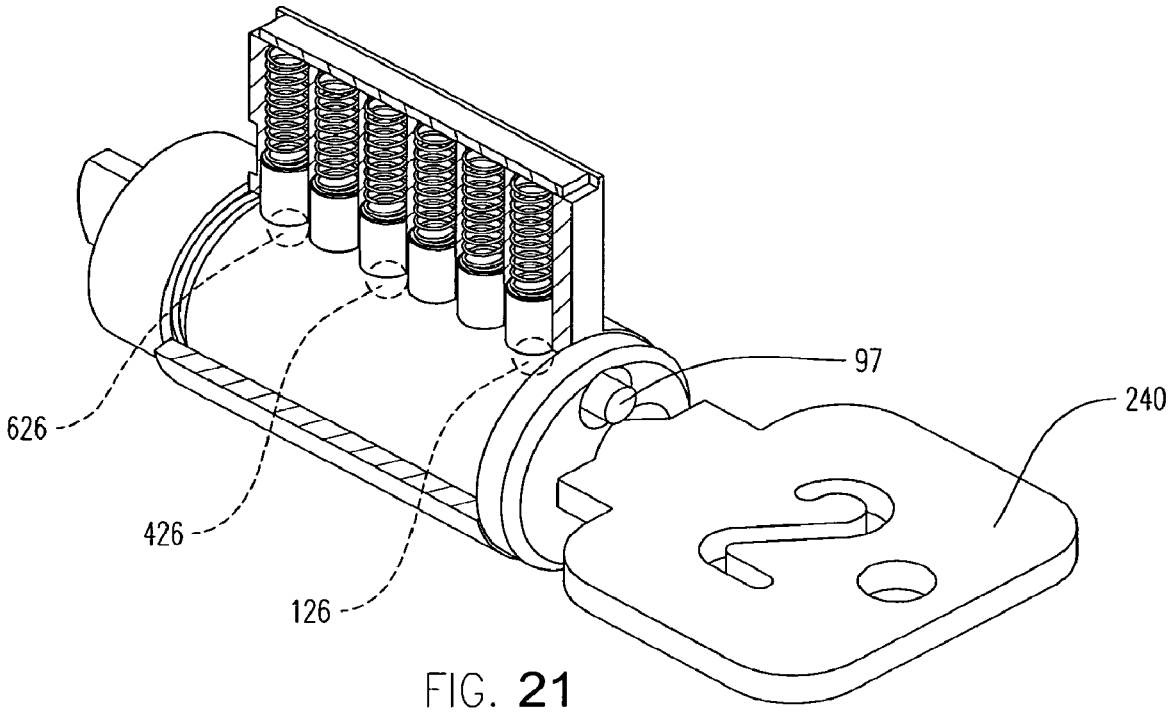
FIG. 21 shows the lock and second user key shown in FIG. 20, in the programming position, with change members deposited in their respective retainer cavities.
Figure 22:
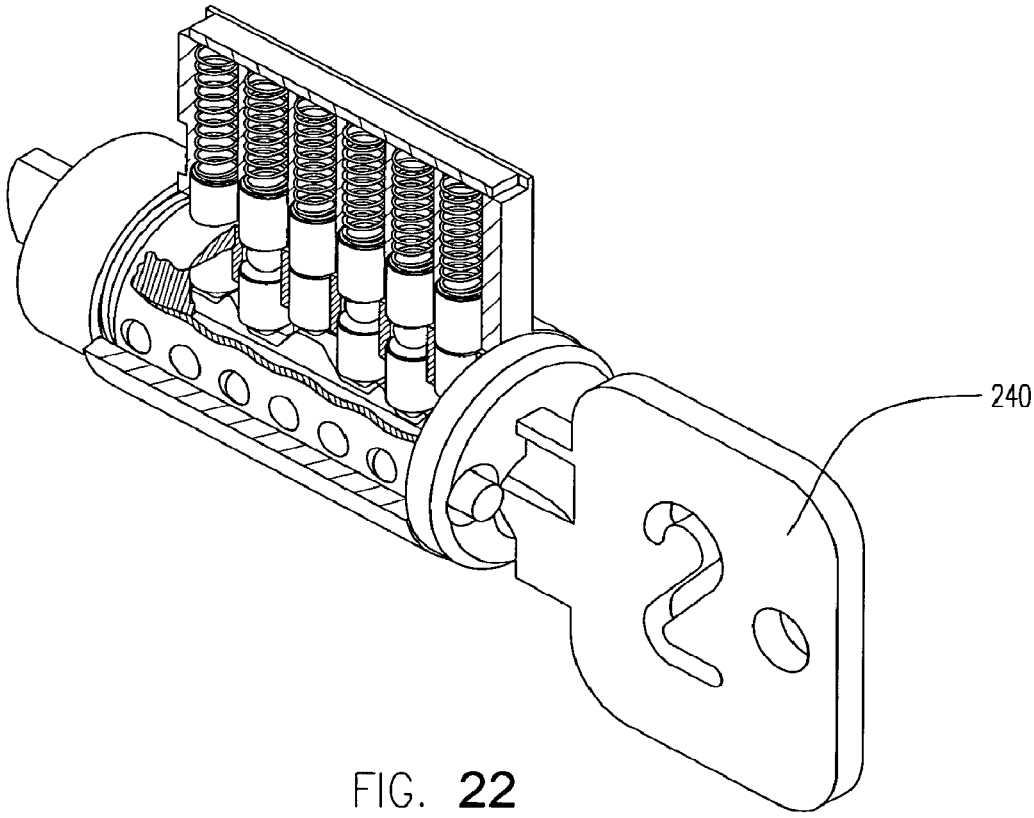
FIG. 22 shows the lock with the second user key inserted, now configured for operation with the second user key.

From the null configuration, any user key 40 can be inserted to reconfigure the lock for use exclusively for that particular user key. As shown in FIG. 18, the second user key 240 is inserted fully into the keyway 11. The high contour positions of the second user key 240 cause the tumblers 125 and 425 in the first through fourth pin chambers to raise the corresponding change balls 126 and 426 above the shear line 19. The lowered contours at contour positions 42, 43, 45 and 46 of user key 240 (see FIG. 6) can only raise the tops of the corresponding change balls 226, 326, 526 and 626 to proximate the shear line 19. With the second user key 240 inserted, the plug 10 is first rotated clockwise toward the programming position, as shown in FIGS. 19 and 20. As the second user key is rotated toward the programming position, the change balls 126 and 426 in the first through fourth pin chambers ride along the periphery 12 of the plug as shown in FIG. 19. FIG. 20 shows the change balls 126 426, and 626 frozen in position at that moment in time when the plug 10 arrives fully at its programming position. In real time, as soon as the three change balls 126, 426 and 626 are disposed proximate the openings of the corresponding retaining cavity 16, the drivers 127 and 427, respectively, biased by the respective driver springs 28, will force the change balls into their respective retaining cavities 116, 416 and 616, as shown in FIG. 21. When change balls 126, 426 and 626 have been deposited in their second position in the corresponding retainer cavities, the lock is deemed configured for use with the second user key 240. Once configured for operation with the second user key, plug 10 can be rotated back to the first rotated position as shown in FIG. 22. From its first rotated position, the second user key 240 can rotate the plug 10 oppositely to its third rotated position to operate the lock and lock the latch.

Figure 23:
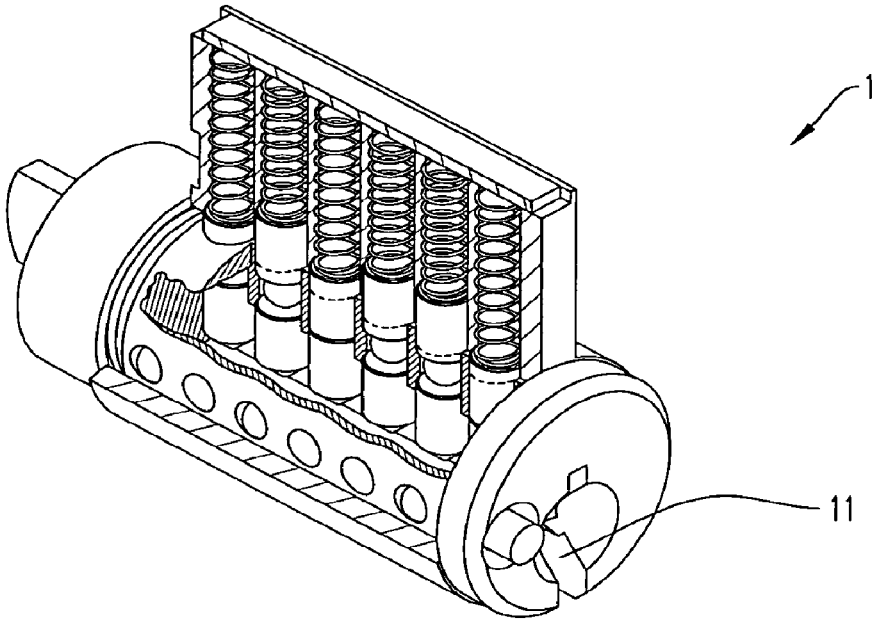
FIG. 23 shows the lock, configured for operation with the second user key, without a key inserted.
Figure 24:
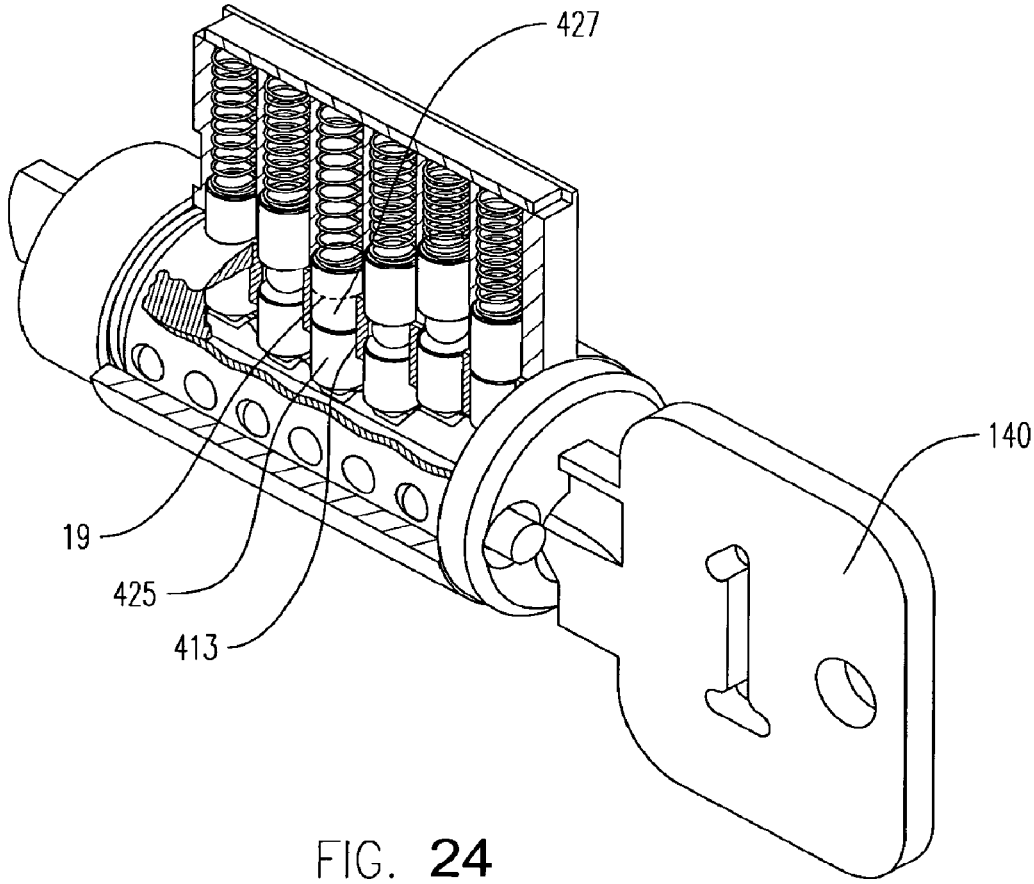
FIG. 24 shows the lock, configured for operation with the second user key, with the first user key inserted.

FIG. 23 shows the lock 1 of the present invention configured for operation with the second user key 240, after the second user key has been withdrawn from the keyway 11. In this configuration the lock is uniquely configured for operation only with the second user key 240 or the programming key 540. Operation of the lock by the first user key 140 is precluded. As shown in FIG. 24, when the first user key 140 is inserted into the keyway 11 of the lock that is configured for operation with the second user key 240, the fourth driver pin 427 cannot be raised by the fourth contour position of the key 140 to a height sufficient to align the bottom end of the driver 427 with shear line 19, such that the body of the driver 427 stands across the shear line 19. While the operable second user key 240 has a high cut in the fourth contour position, the first user key 140 has a low cut in the fourth contour position, which in combination with the deposit of the fourth change ball 426 in its corresponding retainer cavity, only permits the first user key 140 to raise the lower end of the driver 427 to an intermediate position within the fourth tumbler chamber 413. Consequently, when the lock is configured for operation with the second user key 240, the first user key 140 cannot operate the lock to rotate the plug and undo the latch.

It can be understood that the lock assembly of the present invention can comprise a number of additional user keys which have a different combination of raised and lowered contour at different contour positions, whereby operation of the lock when configured for any one such additional user key would preclude operation by either the first or the second user keys, or any other user keys. Furthermore, the contour positions of these additional user keys would preclude the use of any of these additional user keys to rotate the plug to the programming position, unless the lock has been set to the "null" configuration, described above and shown in FIG. 17.

The illustrated embodiment utilizes user keys 140 and 240, shown in FIG. 6, each having two raised "user" contour positions: contour positions 41 and 42 for user key 140, and contour positions 41 and 44 for user key 240. The remaining "user" contour positions are lowered. It can be understood that the lock assembly of the present invention can comprise a number of additional user keys having a different combination of two raised "user" contour positions from among contour positions 1 through 5, and the remaining as lowered contour positions, whereby operation of the lock when configured for such additional user keys would preclude operation by either the first user key 140 or the second user key 240, or yet other user keys. By staggering two raised contour locations over a total of five contour locations, 10 different key configurations can be achieved. Similarly, staggering three raised contour locations over the total of five user contour locations provides also for 10 different key combinations, while staggering either four raised contour locations, or one raised contour location, over the five total locations, results in only 5 different lock configurations. The subset of keys can also include user keys having a different number of raised contour locations.

In the illustrated embodiment, the programming key 540 can also serve as a "lockout" key that prevents the lock from being operated with any user key. As shown in FIG. 14, the programming key 540 can be inserted into the keyway 11 and rotated to the programming position, wherein all the change balls 26 have been deposited into their respective retainer cavities 16. If, instead of depressing the end button 97 and engaging the change tooling 50 as shown in FIG. 18, the programming key 540 rotates the plug 10 back to the first rotated position and is removed, then all the change balls 26 are disposed in their corresponding retainer cavities 16, and none of the user keys 140 and 240, or any other user key, can operate or rotate the lock. As described herein above, each user key has at least one lowered contour position, and when a user key having one or more lowered contour positions is inserted into the lock that is configured with a change ball disposed in a corresponding retainer cavity, that user key can not raise the corresponding driver high enough to align with the shear line; that is, in the pin chambers corresponding to the lowered contour positions of the user key, the driver body spans the shear line and prevents the plug from rotating. This is illustrated in FIG. 24, where the lower contour position 144 of first user key 140 can not raise driver 427 above the shear line of the lock when configured for the second user key 240, while the corresponding fourth change ball 426 is disposed in its second position in the retainer cavity (not shown).

Figure 25:
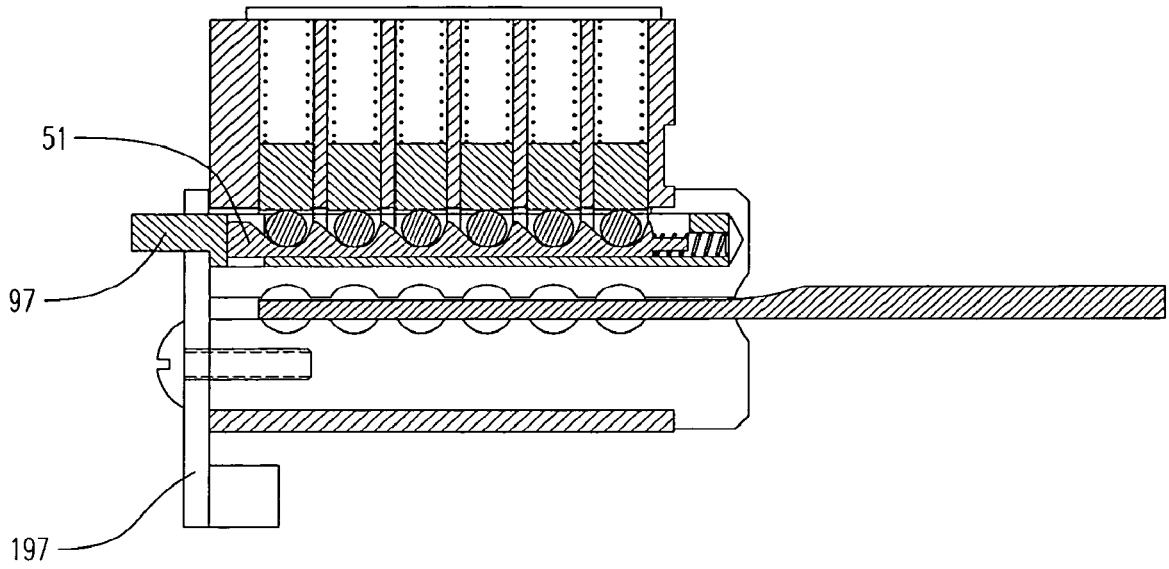
FIG. 25 shows an alternative embodiment of a lock of the present invention having a change tooling extending from the rear portion of the plug.

FIG. 25 shows an additional embodiment of the lock having the depressable button 97 of the integral change tooling extending from the rear end of the lock. The retaining latch and threaded cap of the earlier embodiment of FIG. 3 can be replaced with a latch plate 197 that is secured to the back or rear end of the plug 10 with a securement, such as a screw. The latch plate 197 rotates dependently with the plug 10 to latch closed or open a door or other device, such as a security box. In the illustrated embodiment, the counter-bore into the plug face is eliminated, and the return spring 95 is first inserted ahead of the change tool 51. The depressable button 97 is lastly inserted.

The embodiment described above and illustrated in FIG. 25 can also be associated with a conventional retaining latch 34, as typically used in a deadbolt-type lock, within the depressable button 97 extends rearward and can be depressed with a finger or other implement through the deadbolt knob on the side of the door opposite the keyway opening.

In another embodiment of the present invention, the integral change tooling can be configured and used in a changeable or programmable lock that can be programmed for use with one of a plurality of user keys without disassembling the lock or replacing the tumblers. The lock operates with a user key so that the plug turns only in one direction to unlatch or unbolt, and can not operate or rotate in the opposite direction. The lock also cannot be programmed or reconfigured with an operable user key. The lock is typically manually latched or bolted into a locked configuration. The lock is configured to permit rotation in the opposite direction only when using a programming key, which can reconfigure or program the lock for use with another user key. The plug is configured to restrict rotation in only one direction when using a user key, by forming a groove of the proximate one of the tumbler chambers, termed the programming chamber. The groove forms a ramp that extends from the periphery of the plug to an intermediate point of the programming tumbler chamber. When any operable user key is inserted into the keyway, the programming contour position of the blade of the key raises the tumbler and driver within the programming pin chamber to a height wherein the lower end of the driver is adjacent the ramp at the intermediate point of the tumbler chamber. Although the driver upon key insertion is spanning the shear line, rotation of the user key and plug in the one direction causes the driver to move along and up the ramp, and fully into the driver chamber, thus permitting full rotation of the plug to the second, or unlock, position. The tapered ramp provides the programming pin chamber with a second shear line at the edge of the ramp that intersects the programming tumbler chamber. The second shear line provides rotation of the plug only in the first direction, toward the first rotated position of the plug, when the upper end of the programming tumbler is aligned therewith, even when a driver or other element is spanning the primary shear line. U.S. Patent Publication 2006/0021406, published Feb. 2, 2006, incorporated herein by reference, discloses a programmable lock that is configured to operate in only one direction with a user key, which can employ the integral change tolling of the present invention.

In another embodiment of the present invention, a method is provided for using the lock by providing a means for rapidly changing the internal configuration of the drivers, tumblers and change balls of the lock to program the lock to operate exclusively with one user key of a set of user keys. The method of using the rapidly-changeable lock does not require disassembly, or removal of the plug from the housing. The method involves inserting a programming key into the keyway of the lock that is configured to operate with a first user key. The inserted programming key provides for rotation of the plug in an opposite direction, to a programming position. The programming key also provides that any change ball disposed within the pin chambers is forced up into its respective driver chamber, and is subsequently deposited within its respective retainer cavity. The lock is then configured into a reset position by manipulating a integral change tool in a change slot, which engages the retainer cavities that are configured in the plug to retain the change balls, and displaces the change balls from their retainer cavities into their respective driver chambers, and then rotating the plug back to its first rotated position (the key insertion position). From the reset configuration, the change tool can be disengaged and the programming key can be removed from the lock, and replaced with the new user key. The contour positions of the new user key raise the corresponding change balls within the pin chambers to either a position within the tumbler of the plug, or a position with its centerline above the shear line or within the driver chamber of the housing. The configuration or pattern of change balls raised above the shear line and into the driver chamber is different from such pattern of the previous user key. Subsequent, rotation of the new user key back to the programming position causes any change balls that became isolated in the driver chamber to be deposited into their respective retainer cavities. After returning the plug to the initial or first rotated position, the lock has been reconfigured or programmed for use with the new user key, and renders the previous user key inoperable.

In an alternative embodiment, the retainer cavity can be disposed on the opposed side of the plug, whereby rotation of the plug to its second position is in the counter-clockwise direction.

In another embodiment, the lock can be provided with one or more of a means for signaling to the user that the key and plug are in the first rotated position (or the key insertion position). A typical plug position signaling means is a detent and pin, which is described in paragraphs 0105 through 0108, and in FIGS. 31 through 33 of the above-mentioned US Patent Publ. 2006-0021406.

Methods of making the changeable lock described herein that includes the forming of the retainer cavities into the plug are described in paragraphs 0109 through 0112, and paragraphs 0115 through 0122, of the above-mentioned US Patent Publ. 2006-0021406.

The integral change tooling can be formed into the plug in a variety ways that provide for movement of the change tool by manipulation. One method comprises the following steps for forming change tooling that is manipulated by depressing a button on the front face of the plug. A first bore is formed parallel to the axis of the plug through the back end of the plug toward, but short of, the front face of the plug. The bore intersects the retainer cavities, but does not interest the plug periphery. A counter bore is then drilled through the center of the end of the first bore, through the front face of the plug. A button having a shoulder is inserted head-first into the bore to protrude out of front face of the plug through the counter bore. The shoulder retains the change tooling within the bore.

The embodiments of a changeable lock assembly can be used in a variety of locking devices. These locking devices include both commercial and residential locks, and include by example, knob locks, deadbolt locks, and padlocks. The operation of a typical knob lock can include the use of the operable key both to unlock and lock the door knob by turning a latch that is secured to the latch end of the plug, or to provide only for unlocking of the latch. In the later embodiment, the latch typically unlocks the door knob, which can then turn or rotate by hand, and thereby operate an elongated bolt that engages and disengages the jamb of the door or other object that is being locked. The operation of a typical dead-bolt lock includes the use of the operable key to unlock and rotate a latch that drivers an elongated bolt to engage and disengage the jamb of the door or other object that is being locked. These locks are well-known to one skilled in the art.

The invention also relates to a convenient lock kit. The kit includes a changeable lock assembly according to the above, instructions for use, an optional subset of keys, and a means for securing the keys, lock assembly, and the instructions. The optional subset of keys includes at least a first user key having a first contour edge that operates the lock in a first lock configuration but does not operate the lock in a second lock configuration, and a second user key having a second contour edge that operates the lock in the second lock configuration but does not operate the lock in the first lock configuration, wherein the first contour edge and the second contour edge have at least a first contour position and a second contour position that are differently configured, and a programming key to change to configuration of the lock. The subset of user keys can also be separately packaged. The kit or package for the subset of keys can comprise at least two user keys, and as many as ten user keys, depending upon the lock configurations.

The set of instructions provide a set of detailed instructions for use of the user keys, the programming key, and any master key that may also be provided. These instructions include illustrations, or written directions, or both for use of the programming key and the integral change tool to reset the lock for use with a different user key, or to "lockout" all user keys. The instructions are selected from the group consisting of written instructions, pictorial instructions, audio instructions, video instructions, and mixtures thereof. Typically instructions include a combination of written instructions and pictorial instructions, in the form of an instruction sheet or card. The instructions can also include an audio/video tape or DVD, which includes a video demonstration of operation of the lock with the user keys, programming key and integral change tool, and any master key, in combination with oral instructions. Another example of an instruction includes a digital file that can be provided on permanent or semi-permanent digital recording media, such as a CD-ROM or a floppy disk, or can be downloaded from the Internet, and presented by displaying the digital file on a digital file player such as a computer having a video monitor and audio speakers.

The lock kit can be secured in a securement means that can comprise a shrink-wrap plastic film, a plastic bag, and a lidded plastic container.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

I claim:

1. A changeable lock assembly that can be reconfigured to operate with different keys of a set of user keys, without disassembling the lock, comprising:

a) a housing having a cylindrical bore with an inner surface and a plurality of driver chambers intersecting the inner surface;

b) a plurality of drivers, each driver being movable within one driver chamber and being urged toward the bore surface;

c) a plug having a cylindrical periphery and rotatably mounted within the bore so as to form a shear line at the interface of the bore surface and the plug periphery, the plug having a front end and a rear end and being rotatable between a first rotated position and a second rotated position, the plug further having:

1) a longitudinal axis;

2) a keyway formed through the front end of the plug that is oriented parallel to the longitudinal axis and configured to receive a key selected from a subset of keys, the subset of keys including at least a first user key having a first contour edge, and a second user key having a second contour edge, wherein the first contour edge and the second contour edge each have at least a first contour position and a second contour position and are differently configured;

3) a plurality of tumbler chambers intersecting the plug periphery and the keyway, each tumbler chamber being aligned with a driver chamber when the plug is at the first rotated position with respect to the housing so as to form a pin chamber; and 4) a plurality of retainer cavities formed into the periphery, each retainer cavity being spaced apart from a corresponding tumbler chamber and aligned with a corresponding driver chamber when the plug is at the second rotated position with respect to the housing; and 5) a change tooling configured integrally with the plug, and comprising a plurality of biasing surfaces, each of said plurality of biasing surfaces associated with one of the plurality of retainer cavities, the change tooling being moveable by manipulation only between a first position within the plug and a second position within the plug;

d) a plurality of tumblers, each tumbler being movable within a tumbler chamber;

e) a plurality of lock configuration change balls, each ball being associated with one pin chamber and one of the plurality of retainer cavities, and being movable within the lock between a first position within the associated pin chamber between the driver and tumbler, and a second position within the associated retainer cavity, wherein the user configuration of the lock is based upon the positioning of the change balls in the plurality of pin chambers, wherein each of the plurality of retainer cavities retains the associated change ball, if disposed in the second position, when the change tooling is in its first position, and each of the plurality of biasing surfaces has displaced the associated change ball, if disposed in the second position, from said associated retainer cavity when the change tooling is in its second position.

2. The changeable lock assembly of claim 1 wherein the first user key operates the lock in a first lock configuration but does not operate the lock in a second lock configuration, wherein the second user key operates the lock in the second lock configuration but does not operate the lock in the first lock configuration.

3. The changeable lock assembly of claim 1 wherein the change tooling is manipulated from the front end of the plug.

4. The changeable lock assembly of claim 1 wherein the change tooling is manipulated from the rear end of the plug.

5. The changeable lock assembly according to claim 1 wherein the change tooling is moveable axially within the plug between the first position and the second position.

6. The changeable lock assembly according to claim 1 wherein each driver has a cylindrical shape having a diameter, and each retainer cavity is a cylindrical bore having an opening of a size to accommodate the change ball, and wherein the size of the change ball is smaller than the diameter of the driver, whereby with the plug in the second rotated position, a driver can not enter a retainer cavity with the change ball in the tumbler chamber.

7. A changeable lock assembly that can be reconfigured to operate with different keys of a set of user keys, without disassembling the lock, comprising:

a) a housing having a cylindrical bore with an inner surface and a plurality of driver chambers intersecting the inner surface;

b) a plurality of drivers, each driver being movable within one driver chamber and being urged toward the bore surface;

c) a plug having a cylindrical periphery and rotatably mounted within the bore so as to form a shear line at the interface of the bore surface and the plug periphery, the plug having a front end and a rear end and being rotatable between a first rotated position and a second rotated position, the plug further having:

1) a longitudinal axis;

2) a keyway formed through the front end of the plug that is oriented parallel to the longitudinal axis and configured to receive a key selected from a subset of keys, the subset of keys including at least a first user key having a first contour edge, and a second user key having a second contour edge, wherein the first contour edge and the second contour edge each have at least a first contour position and a second contour position and are differently configured;

3) a plurality of tumbler chambers intersecting the plug periphery and the keyway, each tumbler chamber being aligned with a driver chamber when the plug is at the first rotated position with respect to the housing so as to form a pin chamber; and 4) a plurality of retainer cavities formed into the periphery, each retainer cavity being spaced apart from a corresponding tumbler chamber and aligned with a corresponding driver chamber when the plug is at the second rotated position with respect to the housing; and 5) a change tooling configured integrally with the plug, and comprising a plurality of biasing surfaces, each of the plurality of biasing surfaces associated with one of the plurality of retainer cavities, the change tooling being moveable by manipulation between only a first position within the plug wherein each of the plurality of biasing surfaces is in a first position out of engagement with the associated retainer cavity such that a change member disposed in said retainer cavity is not biased out of said retainer cavity, and a second position within the plug wherein said each of the plurality of biasing surfaces is in a second position in engagement with said associated retainer cavity such that a change member, if disposed in said associated retainer cavity, is biased out of said associated retainer cavity;

d) a plurality of tumblers, each tumbler being movable within a tumbler chamber;

e) a plurality of lock configuration change balls, each change ball being associated with one pin chamber and one of the plurality of retainer cavities, and being movable within the lock between a first position within the associated pin chamber between the driver and tumbler, and a second position within the associated retainer cavity, wherein the user configuration of the lock is based upon the positioning of the change balls in the plurality of pin chambers, and wherein each of the retainer cavities retains the associated change ball when the change tooling is in its first position, and each of the plurality of biasing surfaces has displaced the associated change ball from the associated retainer cavity when the change tooling is in its second position.

8. The changeable lock assembly according to claim 7 wherein the change tooling is manipulated from the front end of the plug.

9. The changeable lock assembly according to claim 7 wherein the change tooling is manipulated from the rear end of the plug.

10. The changeable lock assembly according to claim 7 wherein the change tooling is moveable axially within the plug between the first position and the second position.

11. The changeable lock assembly according to claim 7 wherein the change tooling is moveable axially between the first position and the second position.

12. The changeable lock assembly according to claim 7 wherein each driver has a cylindrical shape having a diameter, and each retainer cavity is a cylindrical bore having an opening of a size to accommodate the change ball, and wherein the size of the change ball is smaller than the diameter of the driver, whereby with the plug in the second rotated position, a driver can not enter a retainer cavity with the change ball in the tumbler chamber.

* * * * *